US007798900B2

(12) United States Patent
Nguyen et al.

(10) Patent No.: US 7,798,900 B2
(45) Date of Patent: Sep. 21, 2010

(54) SECURE GAMING SYSTEM

(75) Inventors: Binh T. Nguyen, Reno, NV (US); John Goodman, Reno, NV (US)

(73) Assignee: IGT, Reno, NV (US)

( * ) Notice: Subject to any disclaimer, the term of this patent is extended or adjusted under 35 U.S.C. 154(b) by 820 days.

(21) Appl. No.: 10/408,188

(22) Filed: Apr. 3, 2003

(65) Prior Publication Data

US 2004/0198494 A1 Oct. 7, 2004

(51) Int. Cl.
*A63F 9/24* (2006.01)

(52) U.S. Cl. ..... 463/29; 463/42; 713/190

(58) Field of Classification Search ..... 463/29, 463/40–42, 43, 25; 713/190; 345/163, 189, 345/151; 705/51, 14.12, 76; 380/241; 709/201; 710/105

See application file for complete search history.

(56) References Cited

U.S. PATENT DOCUMENTS 4,882,473 A * 11/1989 Bergeron et al. ..... 463/25
5,249,232 A * 9/1993 Erbes et al. ..... 713/190
5,398,932 A * 3/1995 Eberhardt et al. ..... 463/29
5,505,449 A 4/1996 Eberhardt et al.
5,643,086 A 7/1997 Alcorn et al.
5,915,025 A 6/1999 Taguchi et al.
6,071,190 A 6/2000 Weiss et al.
6,106,396 A 8/2000 Alcorn et al.
6,149,022 A 11/2000 Akyildiz et al.
6,149,522 A * 11/2000 Alcorn et al. ..... 463/29
6,165,072 A 12/2000 Davis et al.
6,251,014 B1 6/2001 Stockdale et al.
6,394,905 B1 * 5/2002 Takeda et al. ..... 463/29
6,443,839 B2 9/2002 Stockdale et al.
6,488,581 B1 12/2002 Stockdale
6,503,147 B1 1/2003 Stockdale et al.
6,508,709 B1 * 1/2003 Karmarkar ..... 463/42

(Continued)

FOREIGN PATENT DOCUMENTS

EP 0360613 3/1990

(Continued)

OTHER PUBLICATIONS

Frenzel, et al., "Electronic Design", Cover Feature: Technology Report, Cryptochips—Help Eliminate the Security Bottleneck, Mar. 17, 2003, pp. 40, 42,44,46, and 48.

(Continued)

*Primary Examiner*—Melba Bumgarner
*Assistant Examiner*—Masud Ahmed
(74) *Attorney, Agent, or Firm*—Weaver Austin Villeneuve & Sampson, LLP

(57) ABSTRACT

A disclosed gaming machine provides methods and apparatus for securing a gaming system. Data files stored on the gaming machine and communications between the gaming machine and its components or external devices are protected using hardware cryptography devices placed at various locations within the gaming machine. Specifically, a hardware cryptography device is used to decrypt encrypted data files stored on the gaming machine or its components before the data files are executed. Additionally, a hardware cryptography device is used to encrypt data files before transmitting them to external devices across a communication path in the gaming machine network. Likewise, the hardware cryptography device is used to decrypt encrypted data files received from external devices.

82 Claims, 15 Drawing Sheets

U.S. PATENT DOCUMENTS

| | | | | |
|---|---|---|---|---|
| 6,875,109 | B2 | 4/2005 | Stockdale | |
| 7,285,048 | B2 * | 10/2007 | Karmarkar | 463/42 |
| 7,294,056 | B2 * | 11/2007 | Lowell et al. | 463/17 |
| 2001/0031663 | A1 * | 10/2001 | Johnson | 463/42 |
| 2002/0116615 | A1 | 8/2002 | Nguyen et al. | |
| 2002/0187828 | A1 * | 12/2002 | Benbrahim | 463/29 |
| 2003/0109306 | A1 * | 6/2003 | Karmarkar | 463/40 |
| 2003/0199320 | A1 | 10/2003 | Nguyen et al. | |
| 2005/0192099 | A1 | 9/2005 | Nguyen et al. | |

FOREIGN PATENT DOCUMENTS

| | | |
|---|---|---|
| EP | 0471538 | 2/1992 |
| EP | 0720098 | 7/1996 |
| GB | 2253931 | 9/1992 |
| WO | WO92/14209 | 8/1992 |
| WO | WO95/10824 | 4/1995 |

OTHER PUBLICATIONS

"Technology Review", Innovation—The Forefront of Emerging Technology, R&D, and Market Trends, Handing Over the Keys—Security chips are on the way, but are they trustworthy?, Feb. 2003, pp. 24-25.

Yuan, et al., "Virtual Private Networks—Technologies and Solutions", pp. 35-43 and 119-123.

Nguyen, et al., "Secured Virtual Network in a Gaming Environment", IGT, U.S. Appl. No. 09/732,650, filed Dec. 7, 2000, pp. 1-42.

Nguyen, et al., "Secured Virtual Network in a Gaming Environment", IGT, U.S. Appl. No. 10/116,424, filed Apr. 3, 2002, pp. 1-87.

LeMay, et al., "Method and Apparatus for Software Authentication", IGT, U.S. Appl. No. 09/643,388, filed Aug. 21, 2000, pp. 1-61.

EP Communication dated Mar. 11, 2008 from EP Application No. 04 758 867.8-1229, 7 pages.

EP Communication dated Sep. 8, 2006 from EP Application No. 04 758 867.8-1229, 6 pages.

Notification Concerning Transmittal of International Preliminary Report on Patentability dated Oct. 27, 2005 from PCT International Application No. PCT/US2004/010396, 7 pages.

Notification of Transmittal of the International Search Report and the Written Opinion of the International Searching Authority dated Sep. 8, 2004 from PCT International Application No. PCT/US2004/0103967, 16 pages.

AU Examiner's First Report dated May 21, 2009 from Australian Patent Application No. 2004227890.

* cited by examiner

SECURE GAMING SYSTEM

BACKGROUND OF THE INVENTION

I. Field of the Invention

The present invention relates to gaming machines such as traditional slot machines, video slot machines, video poker machines, and video keno machines. More particularly, the present invention relates to methods and apparatus for providing a secure gaming system using hardware cryptography devices.

II. Background

Typically, utilizing a master gaming controller, a gaming machine controls various combinations of devices that allow a player to play a game on the gaming machine and also encourage game play on the gaming machine. For example, a game played on a gaming machine usually requires a player to input money or indicia of credit into the gaming machine, indicate a wager amount, and initiate a game play. These steps require the gaming machine to control input devices, such as bill validators and coin acceptors, to accept money and/or credits into the gaming machine and recognize user inputs from devices, including key pads and button pads, to determine the wager amount and initiate game play. After game play has been initiated, the gaming machine determines a game outcome, presents the game outcome to the player and may dispense an award of some type depending on the outcome of the game.

The operations described above may be carried out on the gaming machine when the gaming machine is operating as a "stand alone" unit or linked in a network of some type to a group of gaming machines. As technology in the gaming industry progresses, more and more gaming services are being provided to gaming machines via communication networks that link groups of gaming machines to a remote computer that provides one or more gaming services. As an example, gaming services that may be provided by a remote computer to a gaming machine via a communication network of some type include player tracking, accounting, cashless award ticketing, lottery, progressive games and bonus games.

To prevent the unauthorized access to and tampering with gaming machines and communications over gaming machine networks, which can cost casinos and gaming machine providers significant time and expense, casinos and gaming machine providers have sought to secure their gaming systems. However, traditional methods of securing gaming machines and their communication networks have included costly software development and maintenance. For instance, software authentication, software encryption/decryption, and software replacement or redevelopment (especially in read-only systems) have been used to verify that the contents of gaming machines have not been altered and to prevent unauthorized access to sensitive data. Each of these methods involves software development to implement them, and periodic updates to prevent unauthorized users from discovering and circumventing the security measures in place at any given time. Such software development and ongoing maintenance is costly and distracts from efforts to focus software development on improving gaming machines in other ways.

In addition, equipping legacy machines to operate securely in a network with newer machines can be costly. For instance, in order to be compatible with software-based encryption/decryption schemes, legacy machines must be updated to include encryption/decryption software. Such updates can require costly software re-development and testing, as well as the time-consuming reinstallation of software on each of the legacy machines.

Accordingly, it would be desirable to provide a secure gaming system that can prevent unauthorized access to and tampering with gaming machine contents and communications in a manner that does not require costly software development and maintenance. Furthermore, it would be desirable to provide a secure gaming system that can prevent unauthorized access to and tampering with gaming machine contents and communications in a manner that would allow legacy machines to operate in a network with newer gaming machines without requiring costly software updates to the legacy machines.

SUMMARY OF THE INVENTION

The apparatus and methods of the present invention address the above need by providing a secure gaming system that can prevent unauthorized access to and tampering with gaming machine contents and communications without requiring additional software development and maintenance. The apparatus and methods of the present invention accomplish this by employing hardware cryptography devices that can reduce or obviate the need for costly and time consuming security methods such as software authentication, software cryptography, or replacement of software in read-only systems. Furthermore, the apparatus and methods of the present invention allow legacy machines to operate in a network with newer gaming machines without requiring costly software updates to the legacy machines.

One aspect of this invention pertains to various embodiments of a gaming machine. In one embodiment, the gaming machine may be characterized by the following features: a master gaming controller configured to control a game of chance played on the gaming machine; a file storage device configured to store a plurality of encrypted data files; a first communication path between the master gaming controller and the file storage device; and a hardware cryptography device configured to decrypt, encrypt, or decrypt and encrypt data along the first communication path.

In another embodiment, the gaming machine may be characterized by the following features: a master gaming controller configured to control a game of chance played on the gaming machine, where the master gaming controller includes a memory configured to store a plurality of encrypted data files and a processor configured to execute gaming software programs; a communication path between the processor and the memory; and a hardware cryptography device configured to decrypt, encrypt, or decrypt and encrypt data along the communication path.

In yet another embodiment, the gaming machine may be characterized by the following features: a master gaming controller configured to control a game of chance played on the gaming machine; a first communication board coupled to a master gaming controller, where the first communication board is configured to communicate with a second communication board that is external to the gaming machine; a communication path between the first communication board and the second communication board; and a hardware cryptography device configured to encrypt, decrypt, or encrypt and decrypt data along the communication path before the data passes between the first communication board and the second communication board.

In still another embodiment, the gaming machine may be characterized by the following features: a programmable device configured to execute gaming software programs; a read-only memory configured to store a plurality of encrypted data files; a communication path between the programmable device and the read-only memory; and a hardware cryptography device configured to decrypt, encrypt, or decrypt and encrypt data along the communication path.

In another embodiment, the gaming machine may be characterized by the following features: a master gaming controller configured to control a game of chance played on the gaming machine; a file storage device configured to store a plurality of encrypted data files that are not decryptable by the gaming machine; a communication path between the master gaming controller and the file storage device; and a hardware cryptography device configured to encrypt data along the first communication path before the data reaches the file storage device from the master gaming controller, where the data encrypted by the hardware cryptography device and stored at the file storage device is not decryptable by the gaming machine.

Another aspect of the invention pertains to a method of securing a gaming system. Such method may be characterized by the following sequence: receiving an encrypted file at a hardware cryptography device, where the hardware cryptography device is configured to decrypt data; acquiring a first key at the hardware cryptography device; decrypting the encrypted file using the first key; and executing a gaming software program using the decrypted file.

Another aspect of the invention pertains to computer program products including a machine-readable medium on which is stored program instructions for implementing any of the methods described above. Any of the methods of this invention may be represented as program instructions and/or data structures, databases, etc. that can be provided on such computer readable media.

These and other features and benefits of the present invention will be described in more detail below with reference to the associated figures.

DETAILED DESCRIPTION OF INVENTION

Gaming machines typically operate as either a "stand alone" unit or in a network with other gaming machines and devices. Generally, gaming machines control various combinations of devices that allow a player to play a game on the gaming machine and also encourage game play on the gaming machine. Because gaming machines also determine game outcomes, present the game outcomes to players, and may dispense awards of some type depending on the outcomes of the games, some miscreants may wish to gain access to gaming machines to learn how to "cheat" the gaming machines by triggering illegal jackpots or altering the contents of the gaming machines. Accordingly, it is desirable to secure gaming machines and their networks.

One possible area where a cheater may choose to attack a gaming machine is along a communication path between two gaming devices that exchange information. As an example, along a communication path between a file storage device used to store game programs for generating a game of chance and a master gaming controller on the gaming machine used to execute the game programs, a person wishing to cheat the gaming machine may attempt to alter data that is traveling along the communication path in an illegal manner that is to their benefit. For instance, the cheater may attempt to insert data or a program that illegally triggers a jackpot while he or she is playing. For progressive games, these jackpots can be worth millions of dollars. As another example, a gaming machine operator could illegally alter the odds of winning on a gaming machine to increase their profits by decreasing odds of winning on the machine. Gaming machines are highly regulated to prevent this type of tampering. Devices and methods that prevent this type of tampering may be required by regulators in a gaming jurisdiction where the gaming machine is operated.

In FIGS. 1-4, exemplary gaming machines and gaming machine systems that can be secured according to the apparatus and methods of the present invention are depicted. In particular, various gaming devices and gaming systems, their operation and various communication paths used in their operation are described. In FIGS. 5-14, hardware cryptography devices and associated methods are described that may be used to secure the communication paths for these gaming devices and gaming systems. The cryptography devices and methods described herein may be beneficial for both security and regulatory purposes.

Figure 1:
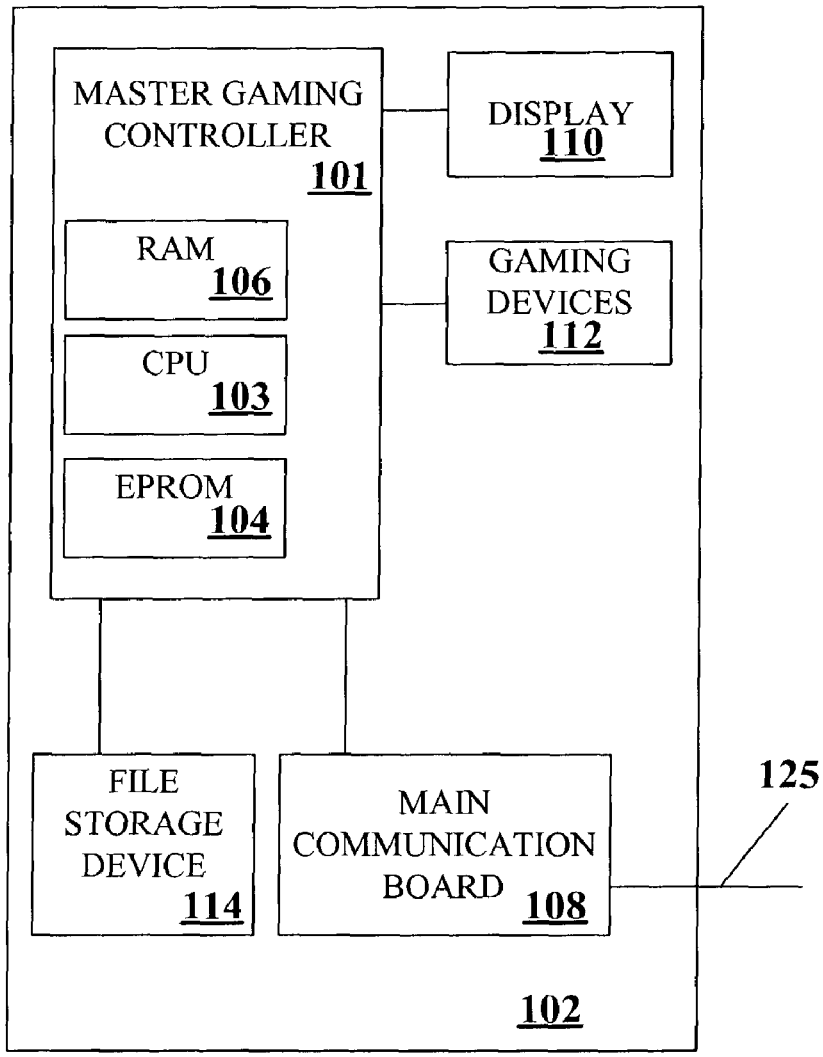
FIG. 1 is a block diagram of a gaming machine.

With reference to FIG. 1, shown is a block diagram of an exemplary gaming machine 102. In the present embodiment, a master gaming controller 101 is used to present one or more games on the gaming machine 102. In particular, the master gaming controller 101 executes a number of gaming software programs to operate gaming devices 112 (see FIG. 4 below) such as coin hoppers, bill validators, coin acceptors, speakers, printers, lights, displays (e.g. 110) and input mechanisms. One or more displays, such as 1110, may be used with the gaming machine depending on the application. The one or more displays may be mechanical displays (e.g., slot reels), video displays or combinations thereof. In addition, the master gaming controller 101 may execute gaming software that enables complex graphical renderings to be presented on the one or more displays 110 as part of a game outcome presentation.

In the present embodiment, the master gaming controller 101 executes various gaming software programs using one or more processors such as a central processing unit (CPU) 103. During execution, a software program may be temporarily loaded into a random access memory (RAM) 106. Various gaming software programs, loaded into RAM 106 for execution, may be managed as "processes" by the gaming machine's operating system. The gaming machine's operating system may also perform process scheduling and memory management. An example of an operating system that may be used with the present embodiment is the QNX operating system provided by QNX Software Systems, LTD (Kanata, Ontario, Canada). Depending on the operational state of the gaming machine, the number and types of software programs loaded in the RAM 106 may vary with time. For instance, when a game is presented, particular software programs used to present a complex graphical presentation may be loaded into the RAM 106. However, when the gaming machine 102 is idle, these graphical software programs may not be loaded into the RAM 106.

Examples of gaming software programs that may be executed on a gaming machine, along with an object-oriented software architecture that can be used to implement these software programs are described in co-pending U.S. patent application Ser. No. 09/642,192, filed on Aug. 18, 2000, and entitled "Gaming Machine Virtual Player Tracking and Related Services," and co-pending U.S. patent application Ser. No. 09/690,931, filed on Oct. 17, 2000, and entitled "High Performance Battery Backed Ram Interface," both of which are incorporated herein by reference for all purposes.

The gaming software programs may be stored on one or more types of file storage media, such as file storage device 114 or EPROM 104. The file storage device 114 may be a hard-drive, CD-ROM, CD-RW, CD-DVD, DVD-R, DVD-RW, static RAM, flash drive, compact flash drive, flash memory, memory stick, EPROM, and the like, or combinations thereof. The file storage media may be located on the gaming machine 102, on other gaming machines, on remote servers, or on combinations thereof. Furthermore, the file storage media can store data files, including executables such as gaming software programs. In addition, the data files can include data generated during routine operation of the gaming machine 102 such as game state information, which can include the number of games played, the number of credits, the number of coins deposited, the number of jackpots, and the like.

In the present embodiment, the master gaming controller 101 may execute gaming software that enables communication between gaming machine 102 and other gaming devices located outside of gaming machine 102, such as player tracking servers and progressive game servers. Specifically, gaming machine 102 can communicate with these outside devices through main communication board 108 and network connection 125.

Figure 2:
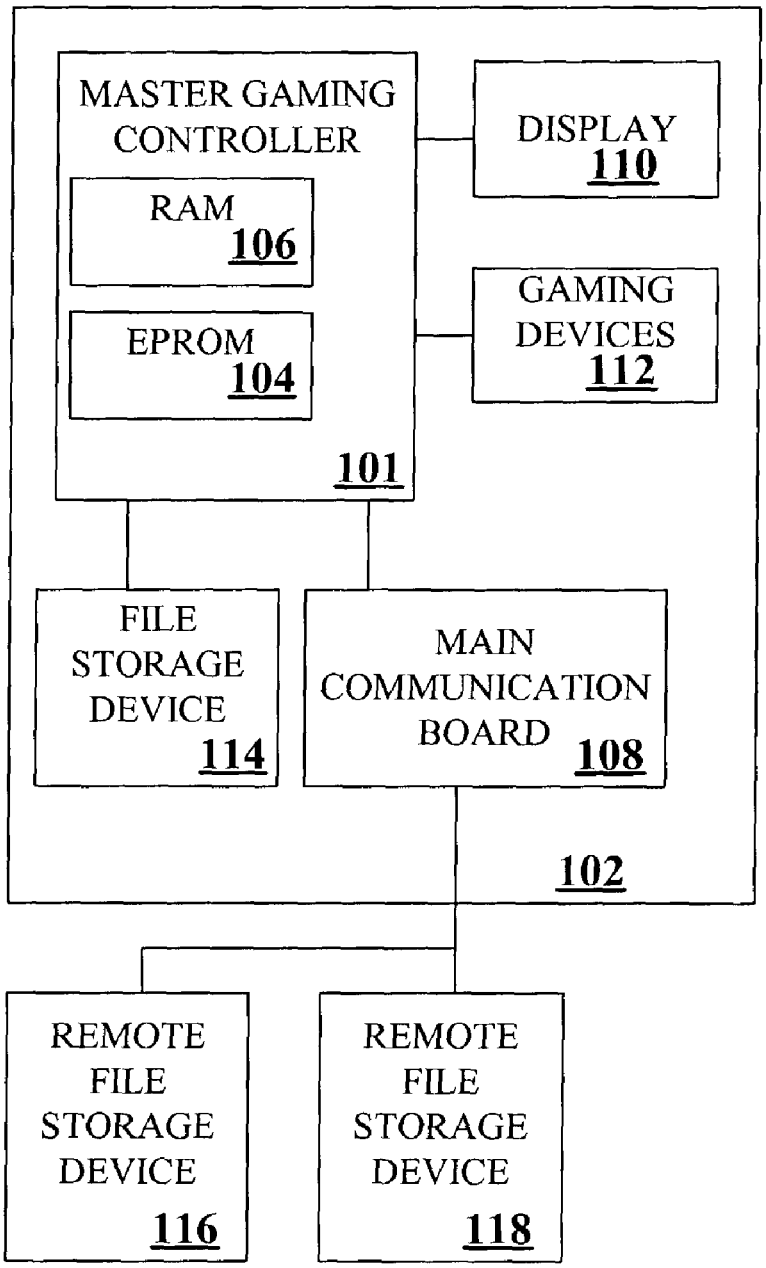
FIG. 2 is a block diagram of a gaming machine connected to remote storage devices.
Figure 3:
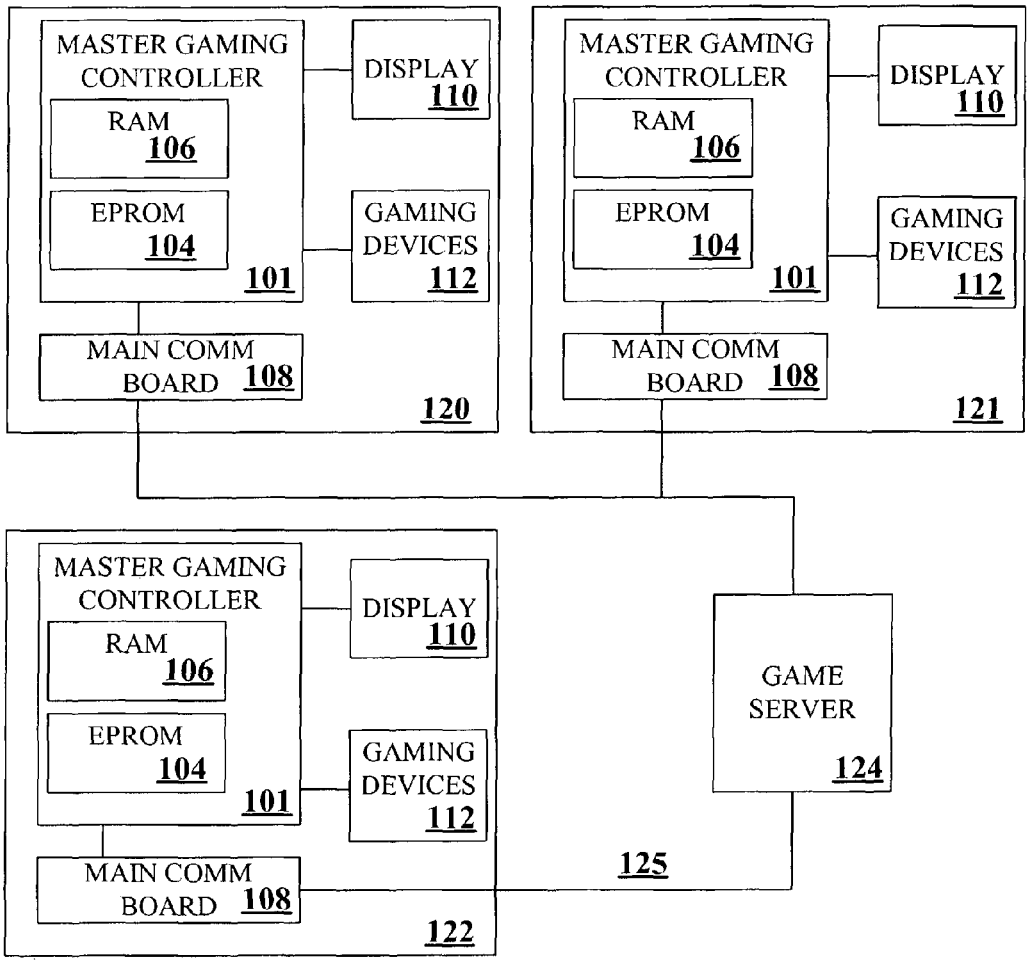
FIG. 3 is a block diagram of gaming machines connected to a game server.

FIGS. 2 and 3 depict alternative embodiments of the gaming machine 102 shown in FIG. 1. With reference to FIG. 2, shown is a block diagram of a gaming machine connected to remote file storage devices that are located outside the gaming machine. In this embodiment, gaming machine 102 is connected to two remote file storage devices 116 and 118 through main communication board 108. These remote file storage devices 116 and 118 can store data files, including executables such as gaming software programs. Furthermore, these file storage device 114 may be hard-drives, CD-ROMs, CD-RWs, CD-DVDs, DVD-Rs, DVD-RWs, static RAMs, flash memories, EPROMs, or combinations thereof.

With reference to FIG. 3, shown is a block diagram of gaming machines connected to a game server. In this embodiment, three gaming machines 120, 121, and 122 are connected to a game server 124 that can store a majority of gaming software programs used on the gaming machine. As shown, the game server 124 can be located outside of the gaming machines 120, 121, and 122, and the game server 124 can communicate with gaming machines 120, 121, and 122 through their respective communication boards 108. In the present embodiment, the gaming machines 120, 121, and 122 do not include local file storage devices (as shown in FIGS. 1 and 2). Instead, gaming machines 120, 121, and 122 can download gaming executables from the game server 124. One example of a game server that may be used with the present invention is described in co-pending U.S. patent application Ser. No. 09/042,192, filed on Jun. 16, 2000, entitled "Using a Gaming Machine as a Server," which is incorporated herein by reference for all purposes. It should be recognized that although the gaming machines 120, 121, and 122 do not include local file storage devices in the present embodiment, gaming machines 120, 121, and 122 can include local file storage devices along with game servers in other embodiments depending on the application.

Although FIGS. 2 and 3 depict various embodiments in which either a remote file storage device or game server is used in conjunction with a gaming machine, it should be recognized that various modifications can be made within the scope of the present application. For instance, a gaming machine can include any combination of file storage devices, remote file storage devices and game servers.

Figure 4:
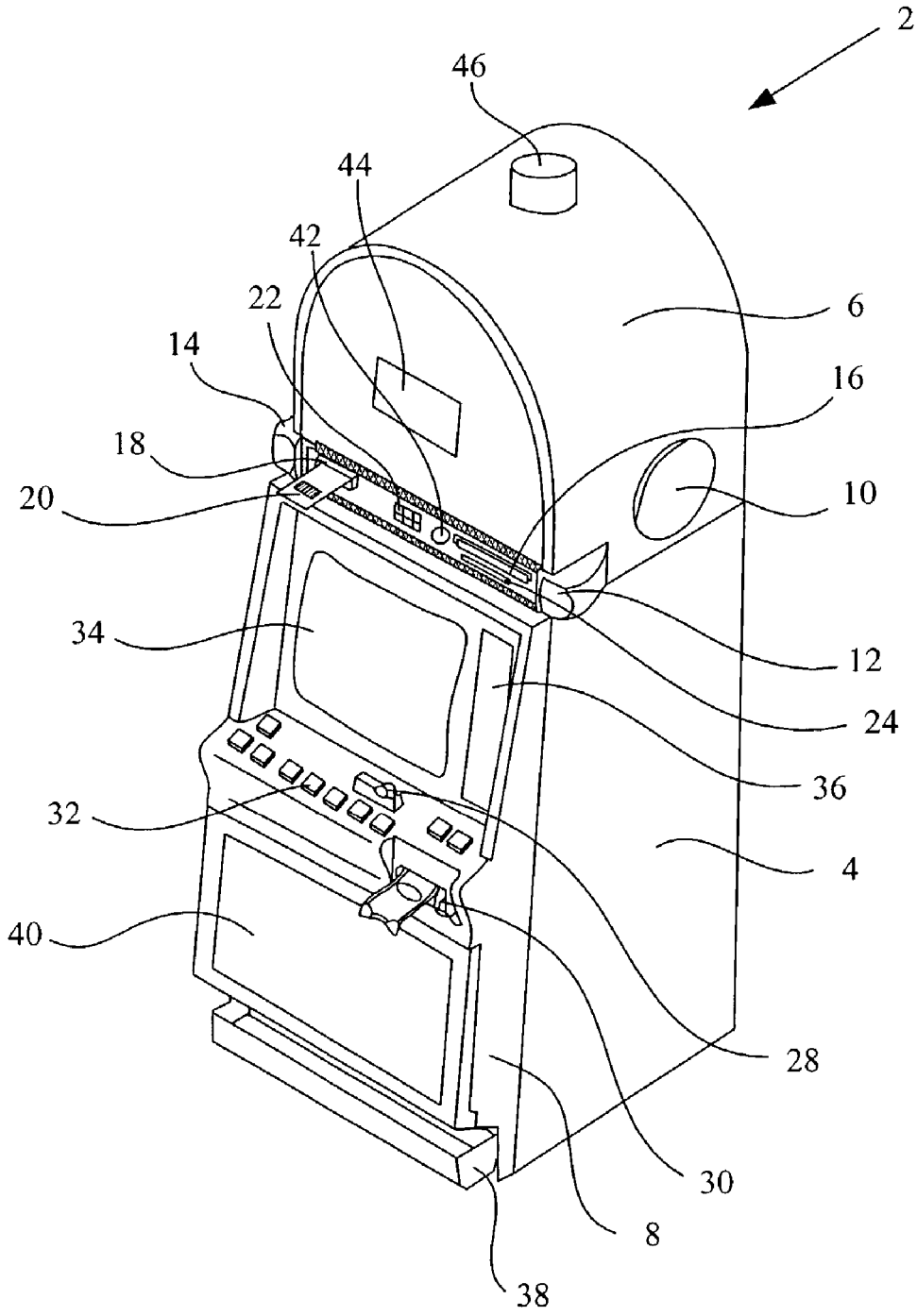
FIG. 4 is a perspective drawing of a gaming machine having a top box and other devices.

Turning now to FIG. 4, an exemplary embodiment of a video gaming machine 2 is shown. Machine 2 includes a main cabinet 4, which generally surrounds the machine interior (not shown) and is viewable by users. The main cabinet includes a main door 8 on the front of the machine, which opens to provide access to the interior of the machine. Typically, the main door 8 and/or any other portals that provide access to the interior of the machine utilize a locking mechanism of some sort as a security feature to limit access to the interior of the gaming machine. Attached to the main door are player-input switches or buttons 32, a coin acceptor 28, a bill validator 30, a coin tray 38, and a belly glass 40. Viewable through the main door is a video display monitor 34 and an information panel 36. The display monitor 34 can be a cathode ray tube, high resolution flat-panel LCD, or other conventional electronically controlled video monitor. Further, the video display monitor 34 can be configured to receive input through devices such as a touch screen or touch pad. In particular, the touch screen or touch pad may respond to inputs made by a player touching, or otherwise activating, certain portions of the screen. The information panel 36 is a back-lit, silk screened glass panel with lettering to indicate general game information including, for example, the number of coins played. The bill validator 30, player-input switches 32, video display monitor 34, and information panel are devices used to play a game on the game machine 2. The devices are controlled by a master gaming controller (not shown), as described above with regard to FIGS. 1-3, housed inside the main cabinet 4 of the machine 2. Many possible games, including traditional slot games, video slot games, video poker, and keno, may be provided with gaming machines of this kind.

The gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a display 16 for displaying player tracking information, a card reader 24 for entering a magnetic striped card containing player tracking information, and a video display screen 42. Furthermore, the top box 6 may house different or additional devices than shown in the present embodiment. For example, the top box may contain a bonus wheel or a back-lit silk screened panel which may be used to add bonus features to the game being played on the gaming machine. During a game, these devices are controlled, in part, by the master gaming controller (not shown) housed within the main cabinet 4 of the machine 2.

It should be understood that although the present embodiment includes the particular features shown in FIG. 4, various gaming machines having different features can be used with the apparatus and methods of the present invention. For example, not all gaming machines have top boxes or player tracking features. Furthermore, some gaming machines have only a single game display, whereas others are designed for bar tables and have displays that face upwards. Furthermore, some gaming machines can have either or both mechanical and video displays. Additionally, some gaming machines are designed to accommodate cashless transactions. In other examples, a game may be generated by a host computer and may be displayed on a remote gaming terminal or a remote gaming device. The remote gaming device may be connected to the host computer via a network of some type such as a local area network, a wide area network, an intranet or the Internet. Furthermore, the remote gaming device may be a portable gaming device such as, but not limited to, a cell phone, a personal digital assistant, and a wireless game player. Thus, those of skill in the art will understand that the apparatus and methods of the present invention, as described below, can be deployed using most any gaming machine now available or hereafter developed.

Returning to the example of FIG. 4, when a user wishes to play the gaming machine 2, he or she inserts cash through the coin acceptor 28 or bill validator 30. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information may also be displayed in the video display screen 42 located in the top box.

During the course of a game, a player may be required to make a number of decisions, which affect the outcome of the game. For example, a player may vary his or her wager on a particular game, select a prize for a particular game, or make game decisions that affect the outcome of a particular game. The player may make these choices using the player-input switches 32, the video display screen 34 or using some other device that enables a player to input information into the gaming machine. During certain game events, the gaming machine 2 may display visual and auditory effects that can be perceived by the player. These effects can add to the excitement of a game, thereby encouraging a player to continue playing. Auditory effects can include various sounds that are projected by the speakers 10, 12, 14. Visual effects can include flashing lights, strobing lights or other patterns displayed from lights on the gaming machine 2 or from lights behind the belly glass 40. After the player has completed a game, the player may receive coins or game tokens from the coin tray 38 or a ticket 20 from printer 18, which may be used for further games or to redeem a prize. Further, the player may receive a ticket 20 for food, merchandise, or games from the printer 18.

As mentioned above, it should be recognized that various modifications can be made to the gaming machine shown in FIG. 4 within the scope of the present application. For instance, in some embodiments the gaming machine 2 can be configured to accommodate cashless transactions. In these embodiments, instead of inserting cash, a player can engage the gaming machine using other inputs such as a player card and/or biometric input. The biometric input can include a retina scan, iris scan, fingerprint scan, voice recognition, and the like. Other modifications can be made to the gaming machine, which can likewise affect player interaction with the gaming machine, within the scope of the present application.

As described above, FIGS. 1-4 depict exemplary gaming machines and gaming machine systems. To prevent the unauthorized access to and tampering with such gaming machines and communications over such gaming machine systems, which can cost casinos and gaming machine providers significant time and expense, casinos and gaming machine providers have sought to secure their gaming systems. Traditionally, one way to prevent the tampering of a gaming machine's software contents and associated devices has been to store the software contents, which typically control the gaming machine and its associated devices, in unalterable memories such as EPROMs or compact disks. Another way to protect sensitive data has been to use fiber optic cables to prevent unauthorized detection or "sniffing" of data from network connections.

With the increased popularity of PC-based gaming technologies, the use of file storage devices such as compact disks, DVDs, and hard drives has also increased. Likewise, low-cost memory devices such as DRAM and NVRAM have gained popularity. In addition, high speed communications, such as Ethernet, USB, and firewire, have increasingly been used to provide fast and convenient networked gaming systems.

Along with the increased use of file storage devices, low-cost memory devices, and high speed communications with gaming machines, has come various ways of protecting these technologies from unauthorized access and tampering. For instance, authentication has been used to protect information stored in RAM or file storage devices. As described in U.S. Pat. No. 5,643,086 by Alcom et al. and entitled "Electronic casino gaming apparatus with improved play capacity, authentication and security"; U.S. Pat. No. 6,106,396 by Alcorn et al. and entitled "Electronic casino gaming system with improved play capacity, authentication and security"; and U.S. Pat. No. 6,149,522 by Alcorn et al. and entitled "Method of authenticating game data sets in an electronic casino gaming system," the contents of a file can be verified by comparing a signature generated from the original contents of the file with a signature generated at the time the file is later accessed. If the two signatures match, then the contents have not been altered between the time the original signature was generated and the time the later signature was generated. However, this type of software-based authentication is typically time consuming because large amounts of data must be hashed to create signatures for comparison. Furthermore, this type of software-based authentication typically involves encrypting the date and signatures, but not the contents of the file. Consequently, files are sent "in the clear," and the contents of the file, which may include sensitive data, are accessible to those who may intercept the file.

Another method that has been used to protect file storage devices is write-protecting the file storage devices. For instance, the write line to a hard drive can be removed, thereby preventing any alteration to the hard drive. However, this solution prevents even authorized updates to the file storage devices. Accordingly, updating the gaming machines can be costly and time consuming when these write-protection security devices are used.

Yet another method that has been used to protect file storage devices is to include an "access sniffing" circuit designed to detect unauthorized tampering of the file storage devices. When a file storage device is accessed for read or for write, the circuit can detect this activity and can reset the system if the activity is unauthorized. However, access sniffing circuits only protect against unauthorized access and writes during game play. Thus, a file storage device, such as a hard drive or memory module, can be removed and reprogrammed without detection by an access sniffing circuit. In addition, once a file storage device is accessed without detection by the access sniffing circuit, the contents of the file storage device can be viewed "in the clear" because the access sniffing circuit is not designed to encrypt the contents.

In addition, one method that has been used to protect data transmitted along communication paths between gaming machine components or between different gaming machines in a network includes using software-based encryption and decryption. In particular, the data can be encrypted by one component or gaming machine before it is transmitted to another component or gaming machine, and decrypted by the recipient component or gaming machine. However, because different components and/or gaming machines in a system are typically made by different manufacturers, they may use different operating systems. Consequently, the encrypt/decrypt software must be written for each of these different operating systems. Providing different versions of the encrypt/decrypt software in this manner can be costly and time consuming. Furthermore, legacy machines that are not equipped with the infrastructure to encrypt/decrypt files need to be updated in order to be compatible with such software-based encryption schemes.

Updating the legacy machines to include new software to encrypt/decrypt files in this manner is also very costly. The software on the gaming machines is highly regulated. Typically, any software changes require resubmission to a gaming regulatory agency. If, for example, a change to the encryption algorithm is required, thousands of existing games can be affected by such changes, and each game must be resubmitted. Once approved, software updates are carried out manually and checked by a representative of a gaming jurisdiction where the gaming machine is located. When the gaming software is stored on an EPROM, the entire EPROM is replaced each time any software on the EPROM is modified and manually installed. After updating the software, such as by replacing the EPROM, an enclosure where the gaming software resides and is executed may be secured by evidence tape to identify when possible tampering has occurred.

Accordingly, the apparatus and methods of the present invention address the above shortcomings of the traditional systems. In particular, the apparatus and methods of the present invention provide a secure gaming system that can prevent unauthorized access to and tampering with gaming machine contents and communications without requiring additional software development and maintenance. Specifically, the methods and apparatus of the present invention employ hardware cryptography devices that can reduce or obviate the need for costly and time consuming security methods such as software authentication, software cryptography, or replacement of software. Furthermore, the methods and apparatus of the present invention allow legacy machines to operate in a network with newer gaming machines without requiring costly software updates to the legacy machines.

Figure 5:
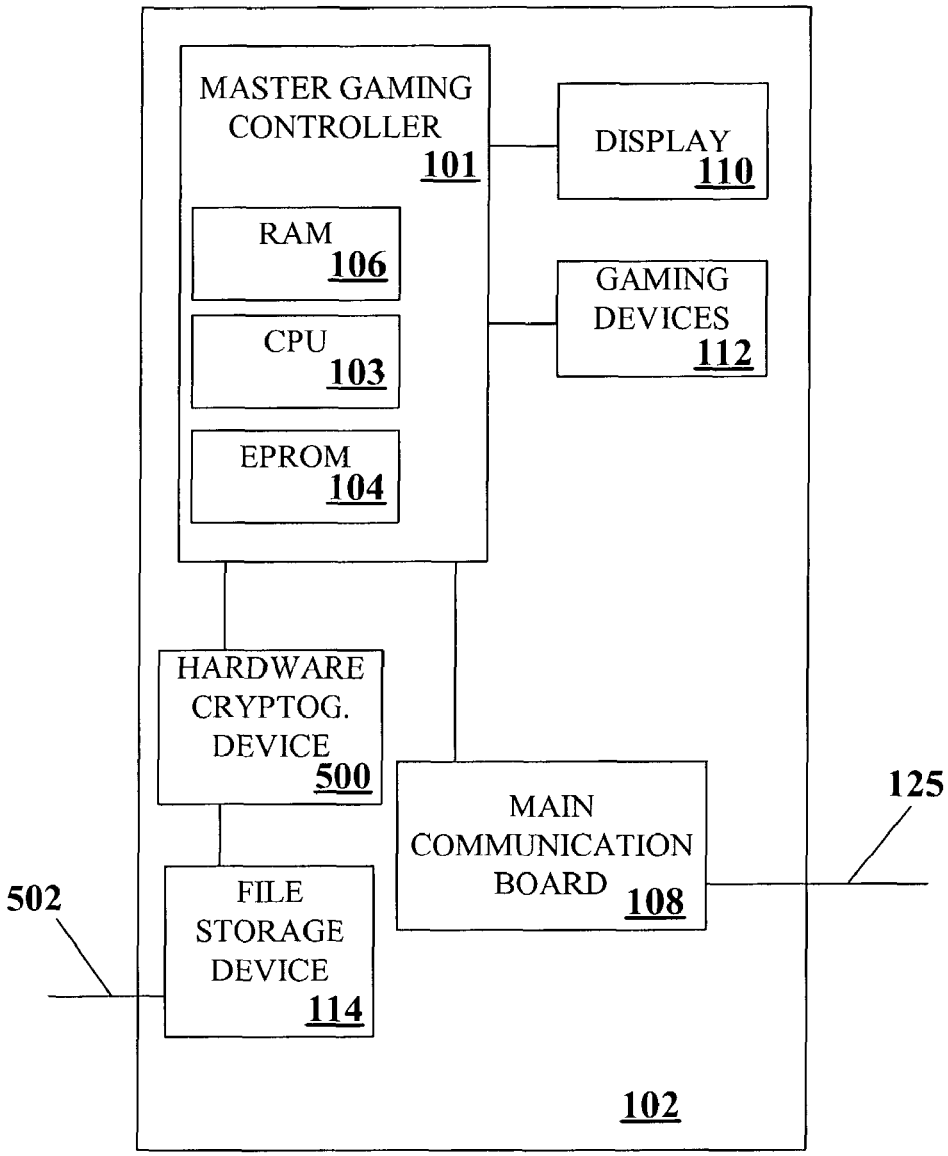
FIG. 5 is a block diagram of a gaming machine with a file storage device that stores encrypted data.

With reference to FIG. 5, shown is a block diagram of one embodiment of a gaming machine that includes a hardware cryptography device in accordance with the methods and apparatus of the present invention. In particular, the gaming machine shown is similar to the gaming machine depicted in FIG. 1 except that FIG. 5 includes a hardware cryptography device 500, a file storage device 114 designed to store encrypted data, and a communication path 502. In the present embodiment, file storage device 114 stores encrypted data files, which can be executable or non-executable files. File storage device 114 can store encrypted data files alongside decrypted data files in some embodiments, depending on the application. In addition, file storage device 114 can store encrypted data files loaded directly onto the file storage device 114 by an operator or from another device within the gaming machine. In some embodiments, file storage device 114 stores encrypted data files received from devices located outside gaming machine 102. Communication path 502 represents a medium through which data files can be received by file storage device 114 from devices external to gaming machine 102 or from an operator. Although communication path 502 is shown as passing directly from file storage device 114 to outside gaming machine 102, communication path 502 can also pass through a communication board such as main communication board 108 on the gaming machine 102 in some embodiments, depending on the application. Storing encrypted data files on file storage device 114 in the manner described above improves the security of gaming machine 102. Specifically, if the file storage device 114 is lost or stolen, the contents of the file storage device 114 are safe from unauthorized users who could otherwise obtain sensitive data from the file storage device 114 if stored in plain view.

Before the encrypted data files stored on file storage device 114 are passed to master gaming controller 101 along a communication path, the encrypted data files are decrypted by hardware cryptography device 500. Hardware cryptography device 500 can be one or more hardware encryption and/or decryption chips, such as the Intel IXP-425 network processor from Intel Corp. (Santa Clara, Calif.), the SE-64 ASIC from eNovatek Corp. (Taipei, Taiwan), the SafeXcel-1140 series from SafeNet, Inc. (Baltimore, Md.), the Hifn-7902 security processor from Hifn, Inc. (Los Gatos, Calif.). Hardware cryptography device 500 can encrypt and/or decrypt data files using one or more symmetric or asymmetric keys. In one embodiment, a single key can be used to decrypt an encrypted data file. The key can be stored in any convenient memory location, such as an EPROM, a USB dongle, a smart card, a secure server, the hardware cryptography device 500, or the master gaming controller 101. Once the hardware cryptography device 500 obtains the key, the hardware cryptography device 500 can use the key to decrypt an encrypted data file. If a symmetric key is used, the same key that was used to encrypt the data file can be used to decrypt the encrypted data file. In contrast, if an asymmetric key was used, a different key from the one used to encrypt a data file can be used to decrypt the encrypted data file.

In another embodiments, two keys can be used to decrypt an encrypted data file. Specifically, one key can be stored with the encrypted data file on the file storage device 114. This key can be used by the hardware cryptography device 500 to decrypt the encrypted data file. In order to prevent an unauthorized user from using this key to decrypt the encrypted data file stored with it on file storage device 114, the key is encrypted by another key. This other key can be stored in any convenient location, such as an EPROM, a USB dongle, a secure server, the hardware cryptography device 500, or the master gaming controller 101. When the hardware cryptography device 500 receives an encrypted data file along with an encrypted key, the hardware cryptography device 500 can retrieve the other key needed to decrypt the encrypted key. Once the hardware cryptography device 500 decrypts the encrypted key, then the newly decrypted key can be used to decrypt the encrypted data file. If symmetric keys are used, the same key that was used to encrypt the data file can be used to decrypt the encrypted data file. In contrast, if asymmetric keys were used, a different key from the one used to encrypt a data file can be used to decrypt the encrypted data file. Using two keys to decrypt and/or encrypt data files provides added security because either or both of the two keys can be changed or updated at any time to prevent unauthorized access to and tampering with the data files. Furthermore, the key stored with the encrypted data file can be easily changed or updated without much time or expense. In some embodiments, the memory location where the key is stored can be removed. In these embodiments, the removable memory location where the key is stored can also be referred to as a "removable key," and can be a PROM, EPROM, USB dongle, smart card, read-only file on a mass storage device, NVRAM module, or the like. In some applications, the read-only file can be a digital certificate, which acts as an electronic "driver's license" that establishes a certificate holder's credentials for transactions over a network, Web, Internet, or the like. Typically, a digital certificate is issued by a certification authority, and includes information such as the certificate holder's name, a serial number, expiration date or dates, a copy of the certificate holder's public key, and the digital signature of the certification authority. The copy of the certificate holder's public key can be used for encrypting messages and digital signatures. In addition, the digital signature of the certification authority can be used by a recipient of the digital certificate to verify that the certificate is authentic. In some instances, the digital certificates can conform to a standard such as X.509. Furthermore, records of digital certificates can be stored in registries. In this sense, a key can be downloaded from the registry, external to the gaming machine, via a key server.

For a general discussion of symmetric and asymmetric keys, including public and private key pairs, see U.S. patent application Ser. No. 10/291,926 by Brosnan et al., filed on Nov. 7, 2002, and entitled "Identifying Message Senders," which is incorporated herein by reference for all purposes. Also, for a general discussion of cryptography, see Schneier, Bruce, Applied Cryptography, John Wiley & Sons, Inc., which is also incorporated herein by reference for all purposes. In addition, for a general discussion of electronic keys and dongles that can be used with the present invention, see U.S. Pat. No. 6,439,996 by LeMay et al., entitled "Key for a Gaming Machine and Method of Use Thereof," issued Aug. 27, 2002, which is also incorporated herein by reference for all purposes.

After the files are decrypted by hardware cryptography device 500, the decrypted files are then passed to master gaming controller 101. These decrypted files can then be read by the master gaming controller 101 if the files were not tampered with while they were encrypted. However, if the files were altered while they were encrypted, the altered content will be decrypted along with the legitimate portions of the data files. Consequently, the decrypted version of the altered content will result in garble that is unparseable. In some embodiments, when unparseable material is detected, then security measures can be triggered. For instance, gaming machine 102 can be reset after unparseable material is found. In addition, casino and/or gaming machine personnel can be notified.

Figure 6A:
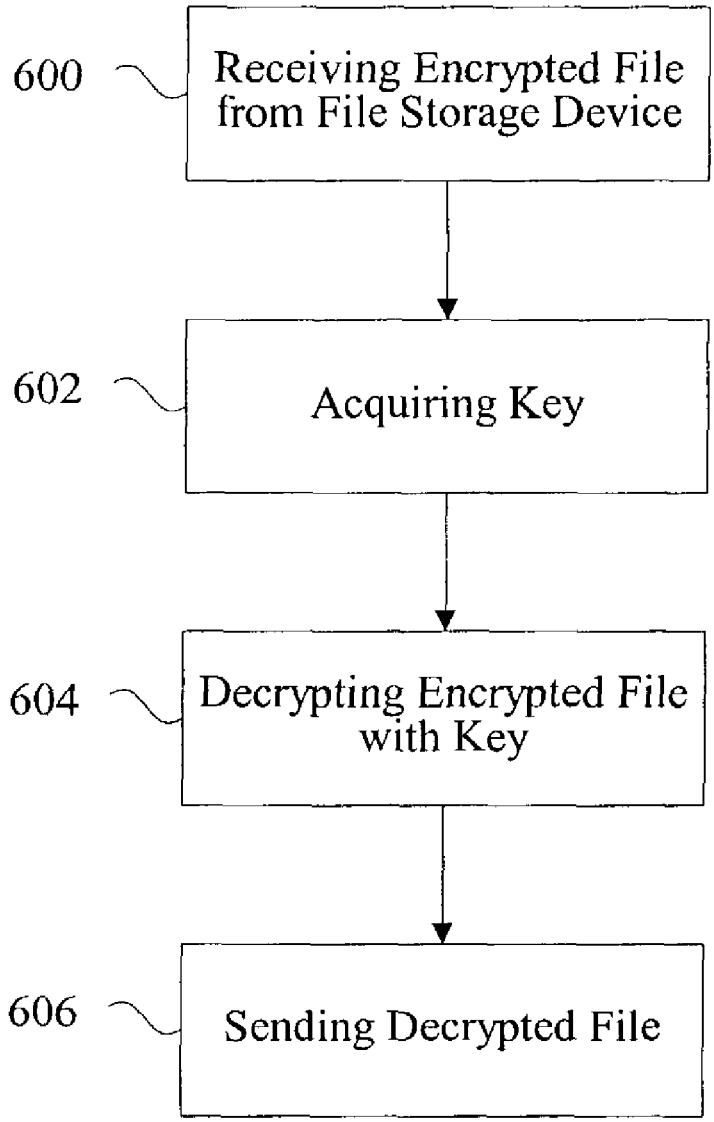
FIG. 6A is a flow diagram depicting a process of securing a gaming system using a file storage device that stores encrypted data.

With reference to FIG. 6A, one embodiment of a process for securing a gaming system using a hardware cryptography device and a file storage device that stores encrypted data is shown. At 600, the hardware cryptography device 500 (FIG. 5) receives an encrypted file from a file storage device 114. Next, at 602, the hardware cryptography device 500 acquires a key from a storage location such as an EPROM, a USB dongle, the hardware cryptography device itself, the master gaming controller 101, or from a secure server. At 604, the key acquired at operation 602 can be used to decrypt the encrypted file. Specifically, as described above with regard to FIG. 5, if a single key is used, the acquired key can be used to directly decrypt the encrypted file. However, if two keys are used, the acquired key can be used to decrypt another key. Once this other key is decrypted, it can be used to decrypt the encrypted file. Any number of keys can be used in a similar manner to protect the contents of the file stored. After the file is decrypted, then at 606, the decrypted file is sent to master gaming controller 101.

As described above, storing encrypted data files at file storage device 114 improves the security of gaming machine 102. Specifically, if the file storage device 114 is lost or stolen, the contents of the file storage device 114 are safe from unauthorized users who could otherwise obtain sensitive data from the file storage device 114 if data files are stored in plain view. Depending on the application, additional features can be included for added security. For instance, gaming machine 102 can detect if the decrypted file includes unparseable material, which suggests either that the encrypted file was altered or that a "rogue" program is operating on the gaming machine. A rogue program is typically introduced onto a gaming machine to trigger illegal jackpots or otherwise tamper with the normal functioning of a gaming machine. The hardware cryptography device can be used to detect such rogue programs by decrypting these rogue programs into unparseable garble when attempting to decrypt legitimate code. Once unparseable material is detected, then security measures can be effected such as resetting the gaming machine, and notifying casino and/or gaming machine personnel.

Another feature that can be included for added security involves checking the integrity of the contents of a data file either before or after it is decrypted by hardware cryptography device. By verifying the contents of the file, gaming machine 102 can determine if the file has been altered in any way. For instance, a check sum algorithm can be used to create a signature for the encrypted or decrypted version of the file, and this signature can be encrypted and appended to the file. When the file is retrieved, the check sum algorithm can be computed again to generate another signature. If the two signatures match, this suggests that the file has not been altered since the time the first signature was generated. Other algorithms and methods can also be used to verify the file in a similar manner.

Yet another feature that can be included for added security involves authentication. As described above, encryption is the process of taking data from a sender and encoding it into a form that only a receiver will be able to decode. Authentication, on the other hand, is used to verify that the information comes from the actual sender. If information received is authentic, the receiver knows who created it and knows that it has not been altered since the sender created it. These two processes, encryption and authentication, can work hand-in-hand to create a secure environment.

In one embodiment, public-private asymmetric encryption keys may be used with the methods and apparatus of the present invention. In a public-private encryption method, information encrypted with the public encryption key may be decrypted only using the corresponding private encryption key of the public-private encryption key pair and information encrypted with the public encryption key may be decrypted only using the private encryption key. Thus, an entity with a private encryption key of public-private encryption key pair may give its public encryption key to many other entities. The public encryption key may be made available (via an Internet server, e-mail, or some other means) to whoever needs or wants it. The private encryption key, on the other hand, is kept secret. Only the owner of the key pair is allowed to possess the private encryption key. The other entities may use the public encryption key to encrypt data. However, as long as the private encryption key remains private, only the entity with the private encryption key can decrypt information encrypted with the public encryption key.

In one embodiment, the identity of a message sender may be determined using public-private encryption key pairs. Two gaming devices, each storing public-private encryption key pairs, may exchange public encryption keys. Then, the gaming devices may exchange a series of messages that are encrypted with each other's public keys. For instance, a first gaming device may send a message with information that is encrypted with a second gaming device's public encryption key. As an example, the information may be a randomly generated number. The information sent by the first gaming device is also stored by the first gaming device.

The second gaming device may receive the message from the first gaming device and decrypt the information with its private key. Then, the second gaming device may encrypt the information with the first gaming device's public encryption key and send a reply message with encrypted information to the first gaming device. The first gaming device decrypts the information in the message using its private encryption key. Then, the first gaming device compares the information sent in the original message with the information received in the reply message. When the information received in the reply message from the second gaming device matches the information sent to the second gaming device, the identity of the second gaming device is authenticated since only the possessor of the private key may decrypt a message encrypted with its public key. Details of exchanging encryption keys in a secure manner, which may be applied to the present invention, are described in co-pending U.S. application Ser. No. 09/993,163, by Rowe et al., filed Nov. 16, 2001 and entitled "A Cashless Transaction Clearinghouse," which are incorporated herein by reference in its entirety and for all purposes.

In general, public-key algorithms are very slow and it is impractical to use them to encrypt large amounts of data. In a symmetric encryption algorithm, the same encryption key is used to encrypt and decrypt information. In practice, symmetric algorithms are used for encryption/decryption of large amounts of data, while the public-private encryption key algorithms are normally used to authenticate sender/receiver and to encrypt the symmetric keys. A more detailed description of authentication and methods of asymmetric and symmetric keys that may be used to transfer encrypted data in the present invention are described in co-pending U.S. patent application Ser. No. 10/116,424, filed Apr. 3, 2002, by Nguyen et al. and entitled, "Secured Virtual Network in a Gaming Environment," and U.S. patent application Ser. No. 10/291,926, filed Nov. 7, 2002, by Brosnan et al. and entitled, "Identifying Message Senders," both of which are incorporated herein in their entirety and for all purposes.

In the present embodiment, master gaming controller 101 and file storage device 114 can each authenticate hardware cryptography device 500, and hardware cryptography device 500 can also authenticate master gaming controller 101 and file storage device 114. Furthermore, file storage device 114 can authenticate other gaming machines or components from which it receives files. It should be recognized that although specific examples are described in conjunction with the present embodiment, other methods can also be used to perform authentication in accordance with the techniques of the present invention.

Figure 6B:
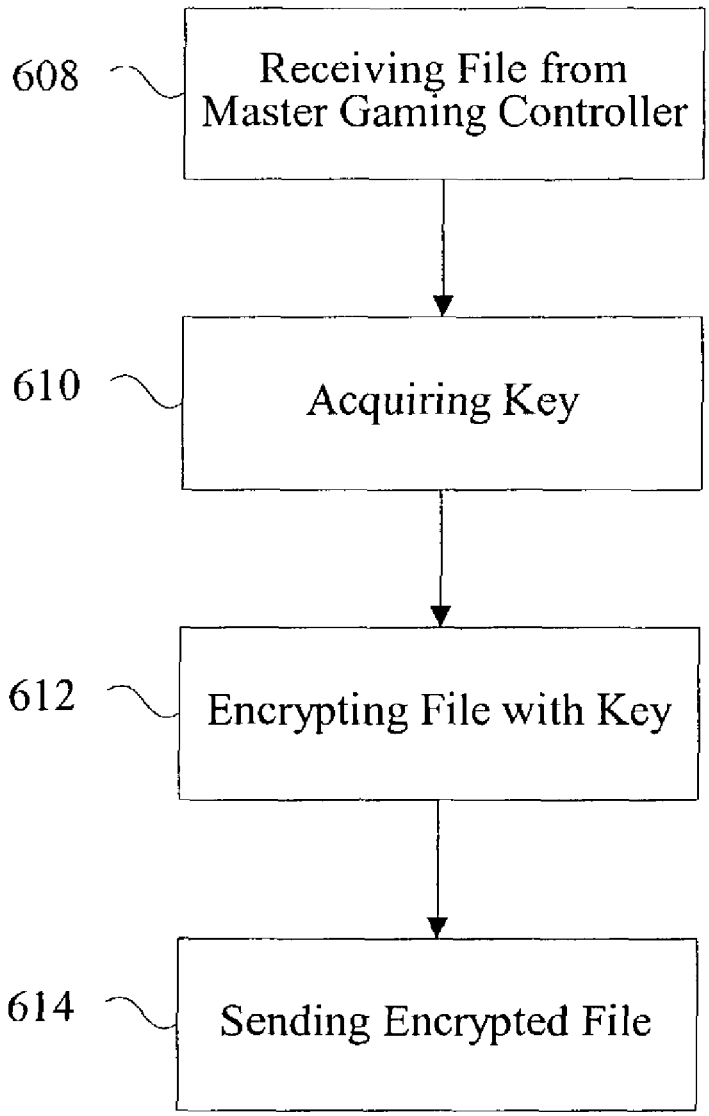
FIG. 6B is a flow diagram depicting another process of securing a gaming system using a file storage device that stores encrypted data.

With reference to FIG. 6B, another embodiment of a process for securing a gaming system using a hardware cryptography device and a file storage device that stores encrypted data is shown. At 608, the hardware cryptography device 500 (FIG. 5) receives a file from master gaming controller 101. Next, at 610, the hardware cryptography device 500 acquires a key from a storage location such as an EPROM, a USB dongle, the hardware cryptography device itself, the master gaming controller 101, or from a secure server. At 612, the key acquired at operation 610 is used to encrypt the file. Specifically, as described above with regard to FIG. 5, if a single key is used, the acquired key can be used to encrypt the file. However, if two keys are used, the acquired key can be used to encrypt the file, and this acquired key can be encrypted with another key. Any number of keys can be used in a similar manner to protect the contents of the file stored. After the file is encrypted, then at 614, the encrypted file is sent to file storage device 114.

The embodiment shown in FIG. 6B can be used alone or in conjunction with the embodiment shown in FIG. 6A. Used alone, the embodiment shown in FIG. 6B can be used to encrypt information that will be stored at file storage device 114 for a third party. For instance, the gaming control board or tax officials may be interested in performing audits of gaming machine activities. These activities can include the amount of money that a gaming machine has received, the amount of money that a gaming machine or set of machines has paid out, and the like. The encrypted information stored on file storage device 114 can be decrypted only by these third parties (or by those authorized by these third parties) and is otherwise unreadable to other parties, including the gaming machine or gaming machine operators. Accordingly, in the present embodiment, hardware cryptography device 500 is equipped to encrypt data, but is not equipped to decrypt data from a file storage device 114 designed to store secure information for a third party.

Although FIGS. 5 and 6 have been described with regard to a particular embodiment, it should be recognized that modifications can be made within the scope of the present application. For instance, decrypted files can be sent from hardware cryptography device 500 to devices within gaming machine 102 other than master gaming controller 101, depending on the application. Furthermore, encrypted files can be sent from hardware cryptography device 500 to devices other than file storage device 114. In addition, file storage device 114 can be located outside gaming machine 102 in some applications as a remote file storage device.

Figure 7:
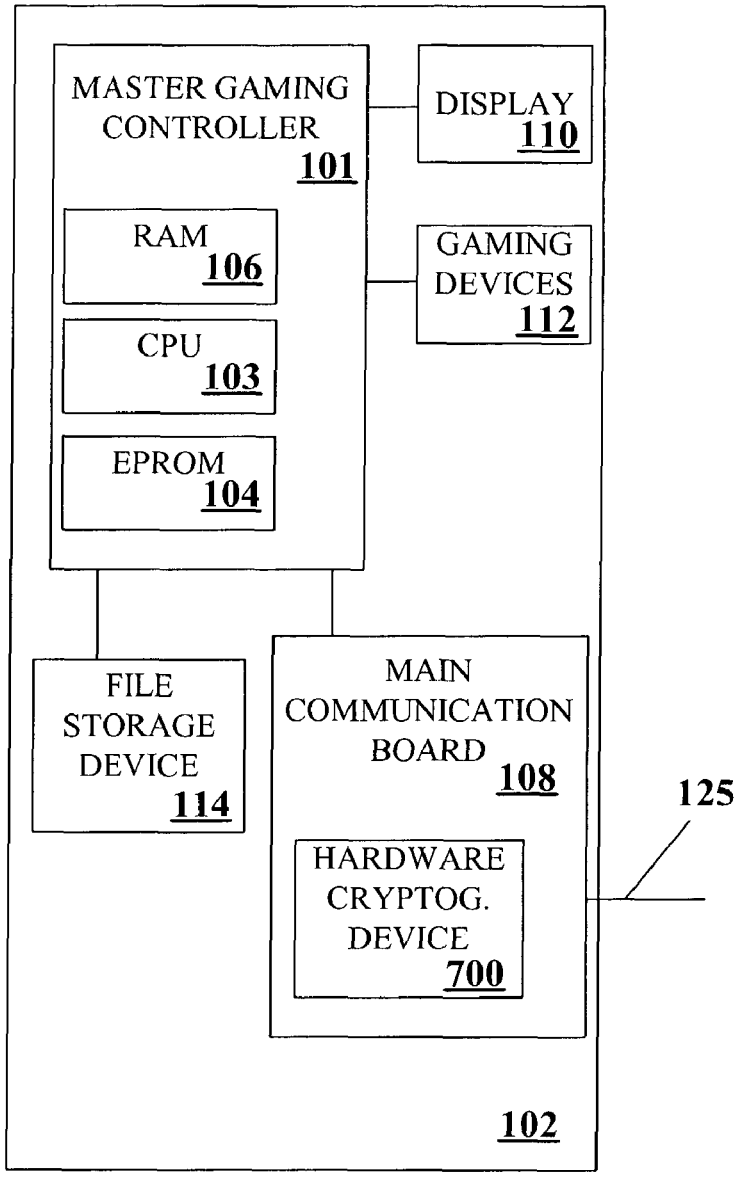
FIG. 7 is a block diagram of a gaming machine system with a secure communication path.
Figure 8:
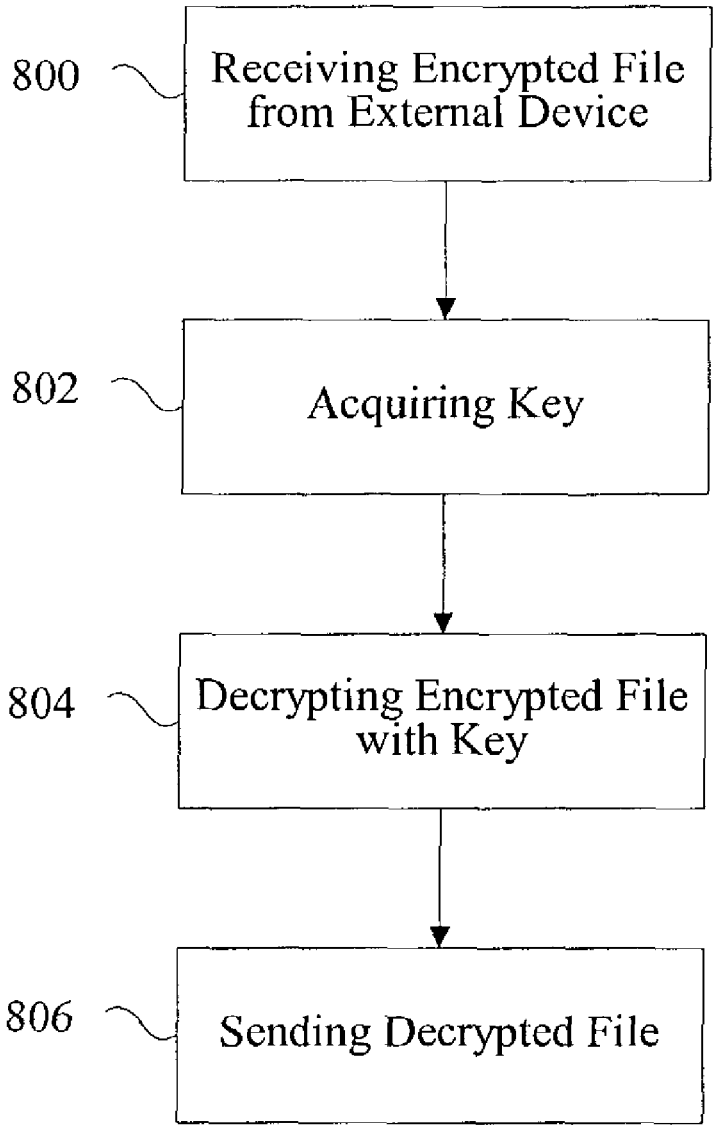
FIG. 8 is a flow diagram depicting a process of securing a gaming system using a secure communication path.

FIGS. 7 and 8 depict an apparatus and process, respectively, for securing a gaming system using a secure communication path. With reference to FIG. 7, shown is a block diagram of one embodiment of a gaming machine that includes a hardware cryptography device. In particular, the gaming machine shown is similar to the gaming machine depicted in FIG. 1 except that FIG. 7 includes a hardware cryptography device 700 associated with main communication board 108. In the present embodiment, gaming machine 102 sends and receives data files to and from external devices through main communication board 108 and communication path 125. These data files can include executable and/or non-executable files.

Before sending a data file to an external device from main communication board 108, hardware cryptography device 700 can encrypt the data file. Encrypting the data file before sending it across communication path 125 in this manner improves the security of gaming machine 102. Specifically, the encrypted data files sent across communication path 125 are safe from unauthorized users who could otherwise obtain sensitive data from the data files if transmitted in the clear. Hardware cryptography device 700 can include one or more hardware encryption and/or decryption chips, such as the Intel IXP-425 network processor from Intel Corp. (Santa Clara, Calif.), the SE-64 ASIC from eNovatek Corp. (Taipei, Taiwan), the SafeXcel-1140 series from SafeNet, Inc. (Baltimore, Md.), the Hifn-7902 security processor from Hifn, Inc. (Los Gatos, Calif.). The hardware cryptography device 700 can be chosen to encrypt data files using one or more symmetric or asymmetric keys. In one embodiment, a single key can be used to encrypt a data file. The key can be stored in any convenient memory location, such as an EPROM, a USB dongle, a smart card, a secure server, the hardware cryptography device 700 used to encrypt and/or decrypt data files, or the master gaming controller 101. Once the hardware cryptography device 700 obtains the key, the hardware cryptography device 700 can use the key to encrypt a data file. Once encrypted, the data file can be sent from main communication board 108 across communication path 125 to an external device. The communications across communication path 125 can be implemented "in the clear," or by using a SSL session, VPN tunnel, hardware-cryptographic-enabled transport, and the like, for additional security. The external device can then receive the encrypted data file at a communication board. If a symmetric key is used to encrypt the data file, a hardware cryptography device at the communication board of the external device can use an identical key to decrypt the encrypted data file. However, if an asymmetric key is used to encrypt the data file, a different key from the key used to encrypt the data file can be used by the external device's hardware cryptography device to decrypt the encrypted data file.

In some embodiments, multiple keys can be used to encrypt a data file. Specifically, if two keys are used, one key can be used to encrypt a data file. This key can be encrypted with another key and sent with the encrypted data file. When the encrypted data file and key are sent to an external device, a hardware cryptography device decrypts the encrypted key with a stored key. This stored key can be the same key used to encrypt the key if symmetric keys are used or a different key if asymmetric keys are used. Once the hardware cryptography device 700 decrypts the encrypted key, then the newly decrypted key can be used to decrypt the encrypted data file. Using multiple keys to encrypt and decrypt data files in this manner provides added security because either or both of the two keys can be changed or updated at any time to prevent unauthorized access to and tampering with the data files. Furthermore, the encrypted key sent with the encrypted data file can be easily changed or updated without much time or expense. In some embodiments, the memory location where the key is stored can be removed. As described in more detail above, the removable memory location where the key is stored can also be referred to as a "removable key," and can be a PROM, EPROM, USB dongle, smart card, read-only file on a mass storage device, NVRAM module, or the like. In some applications, the read-only file can be a digital certificate, which is described in more detail above. For a general discussion of symmetric and asymmetric keys, including public and private key pairs, see U.S. patent application Ser. No. 10/291,926 by Brosnan et al., filed on Nov. 7, 2002, and entitled "Identifying Message Senders". Also, for a general discussion of cryptography, see Schneier, Bruce, Applied Cryptography, John Wiley & Sons, Inc. In addition, for a general discussion of electronic keys and dongles that can be used with the present invention, see U.S. Pat. No. 6,439,996 by LeMay et al., entitled "Key for a Gaming Machine and Method of Use Thereof," issued Aug. 27, 2002.

In the present embodiment, main communication board 108 can also receive encrypted data files from external devices. Main communication board 108 can decrypt encrypted data files in a manner similar to that described above with regard to external devices that receive encrypted data files from gaming machine 102. In particular, with reference to FIG. 8, an exemplary process for securing a gaming system using a hardware cryptography device associated with a main communication board is shown.

At 800, the main communication board 108 (FIG. 7) receives an encrypted file from an external device through communication path 125. Next, at 802, the hardware cryptography device 700, which is associated with main communication board 108, acquires a key from a storage location such as an EPROM, a USB dongle, the hardware cryptography device itself, the master gaming controller 101, or from a secure server. As described above with regard to FIG. 7, this key can be used to decrypt the encrypted file directly or can be used to decrypt another key. At 804, the key acquired at operation 802 can be used to decrypt the encrypted file. Specifically, as described above with regard to FIG. 5, if a single key is used, the acquired key can be used to directly decrypt the encrypted file. However, if two keys are used, the acquired key can be used to decrypt another key. Once this other key is decrypted, it can be used to decrypt the encrypted file. Any number of keys can be used in a similar manner to protect the contents of the file stored. After the file is decrypted, then at 806, the decrypted file is passed on to a destination within the gaming machine 102.

As described above, sending encrypted data files over communication paths improves the security of gaming machine 102. Specifically, the encrypted data files are safe from unauthorized users who could otherwise obtain sensitive data from the data files if transmitted in the clear. Depending on the application, additional features can be included for added security. For instance, gaming machine 102 can detect if the decrypted file includes unparseable material, which indicates that the encrypted file was altered, as described in more detail above with regard to the embodiment depicted in FIGS. 6 and 7. Once unparseable material is detected, then security measures can be effected such as notifying casino and/or gaming machine personnel.

Another feature that can be included for added security involves verifying the contents of a data file either before or after it is decrypted by a hardware cryptography device. By verifying the file, gaming machine 102 can determine if the file has been altered in any way. For instance, a check sum algorithm can be used to create a signature for the encrypted or decrypted version of the file, and this signature can be encrypted and appended to the file before it is sent to gaming machine 102. When the file is received by gaming machine 102, the check sum algorithm can be used to generate another signature. If the two signatures match, this suggests that the file has not been altered since the time the first signature was generated. Other algorithms and methods can also be used to verify the file in a similar manner.

Yet another feature that can be included for added security involves authentication. As described above with regard to FIG. 6A, authentication is used to verify that the information comes from the actual sender. If information received is authentic, the receiver knows who created it and knows that it has not been altered since the sender created it. In one embodiment, the identity of a message sender may be determined using public-private encryption key pairs. Two gaming devices, each storing public-private encryption key pairs, may exchange public encryption keys. Then, the gaming devices may exchange a series of messages that are encrypted with each other's public keys. Although the embodiment described uses asymmetric key pairs, asymmetric and/or symmetric key pairs can be used for authentication, depending on the application. Furthermore, other methods can also be used to perform authentication in accordance with the techniques of the present invention. For a more detailed discussion of authentication, see the discussion above regarding FIG. 6A. In the present embodiment described in conjunction with FIG. 8, main communication board 108 can authenticate external gaming machines or components from which it receives files.

The present embodiment includes various benefits. In particular, because the hardware cryptography device is independent of the operating system and software applications used by the gaming machine, the hardware cryptography device can be used with many applications and many different machines and machine components. For instance, the same hardware cryptography devices can be used on gaming machines running QNX, lottery machines and PTTV running Linux, CVT's running PSOS, floor control servers running Windows 2000, etc. Accordingly, the hardware cryptography device does not require specific software development in order to secure a network of gaming machines having different operating systems and applications. Another benefit is that using hardware cryptography devices to secure communication paths is compatible with legacy machines. In particular, hardware cryptography devices can be built into the legacy machines' communication boards without requiring any software updates or modifications.

Although FIGS. 7 and 8 have been described with regard to a particular embodiment, it should be recognized that modifications can be made within the scope of the present application. For instance, various methods of encryption and decryption, such as those using public and/or private key pairs, can be used with the apparatus and methods of the present invention.

Figure 9:
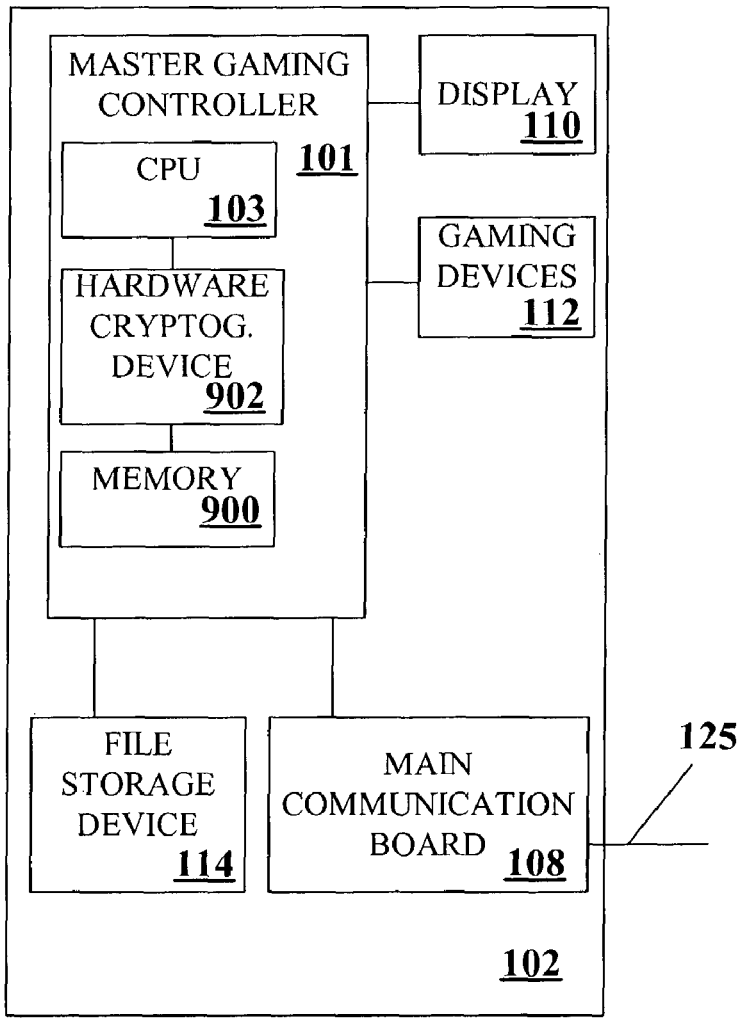
FIG. 9 is a block diagram of a gaming machine with a memory device that stores encrypted data.
Figure 10:
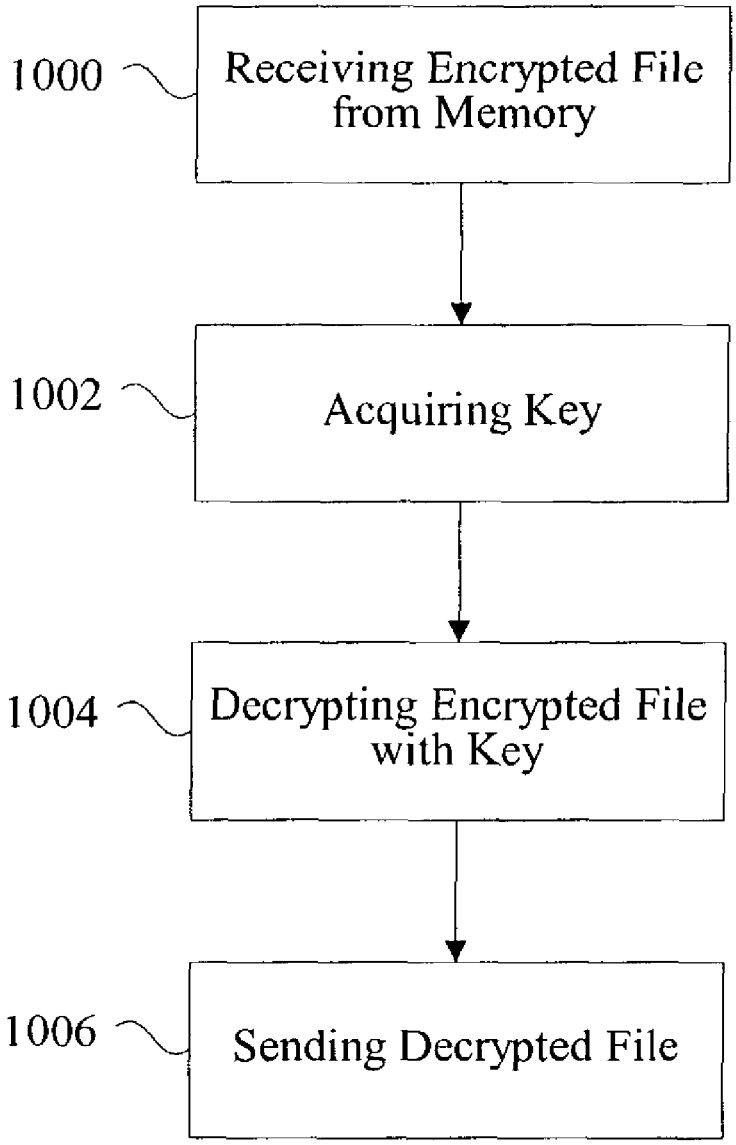
FIG. 10 is a flow diagram depicting a process of securing a gaming system using a memory device that stores encrypted data.

FIGS. 9 and 10 depict an apparatus and process, respectively, for securing a gaming system using a hardware cryptography device and a memory device that stores encrypted data. With reference to FIG. 9, shown is a block diagram of one embodiment of a gaming machine that includes a hardware cryptography device in accordance with the methods and apparatus of the present invention. In particular, the gaming machine shown is similar to the gaming machine depicted in FIG. 1 except that FIG. 9 includes a memory 900 and a hardware cryptography device 902. In the present embodiment, memory 900 stores encrypted data files, which can be executable or non-executable files. For instance, memory 900 can store critical data and game machine states. In addition, memory 900 stores encrypted data files alongside decrypted data files in some embodiments, depending on the application. In some embodiments, memory 900 is a portable memory device that can be removed from the master gaming controller after failure of any associated component, such as a motherboard. When the portable memory device is installed on a replacement board, the gaming machine's previous state before the component failure can be restored. Some examples of portable memory devices include NVRAM modules, USB memory sticks, flash drives, compact flash drives or modules, smart cards, and PCMCIA memory cards. Storing encrypted data files in memory 900 improves the security of gaming machine 102. Specifically, if the memory 900 is lost or stolen, the contents of the memory 900 are safe from unauthorized users who could otherwise obtain sensitive data from the memory 900 if stored in plain view.

Memory 900 stores data files that are used by CPU 102. Before the encrypted data files stored in memory 900 are passed to CPU 102, the encrypted data files are decrypted by hardware cryptography device 902. Hardware cryptography device 902 can be a field programmable gate array (FPGA) and/or one or more hardware encryption and/or decryption chips, such as the Intel IXP-425 network processor from Intel Corp. (Santa Clara, Calif.), the SE-64 ASIC from eNovatek Corp. (Taipei, Taiwan), the SafeXcel-1140 series from SafeNet, Inc. (Baltimore, Md.), the Hifn-7902 security processor from Hifn, Inc. (Los Gatos, Calif.). The hardware cryptography device 902 can encrypt and/or decrypt data files using one or more symmetric or asymmetric keys. In one embodiment, a single key can be used to decrypt an encrypted data file passing from memory 900 to CPU 103. The key can be stored in any convenient memory location, such as an EPROM, a USB dongle, a smart card, a secure server, the hardware cryptography device 902, or the master gaming controller 101. Once the hardware cryptography device 902 obtains the key, the hardware cryptography device 902 can use the key to decrypt an encrypted data file. If a symmetric key is used, the same key that was used to encrypt the data file can be used to decrypt the encrypted data file. In contrast, if an asymmetric key was used, a different key from the one used to encrypt a data file can be used to decrypt the encrypted data file.

In other embodiments, two keys can be used to decrypt an encrypted data file. Specifically, one key can be stored with the encrypted data file in memory 900. This key can be used by the hardware cryptography device 902 to decrypt the encrypted data file. In order to prevent an unauthorized user from using this key to decrypt the encrypted data file stored with it in memory 900, the key is encrypted by another key. This other key can be stored in any convenient location, such as an EPROM, a USB dongle, the hardware cryptography device 902, a secure server, or the master gaming controller 101. When the hardware cryptography device 902 receives an encrypted data file along with an encrypted key, the hardware cryptography device 902 can retrieve the other key needed to decrypt the encrypted key. Once the hardware cryptography device 902 decrypts the encrypted key, then the newly decrypted key can be used to decrypt the encrypted data file. If symmetric keys were used, the same key that was used to encrypt the data file can be used to decrypt the encrypted data file. In contrast, if asymmetric keys were used, a different key from the one used to encrypt a data file can be used to decrypt the encrypted data file. Using two keys to decrypt and/or encrypt data files in this manner provides added security because either or both of the two keys can be changed or updated at any time to prevent unauthorized access to and tampering with the data files. Furthermore, the key stored with the encrypted data file can be easily changed or updated without much time or expense. In some embodiments, the memory location where the key is stored can be removed. As described above, the removable memory location where the key is stored can also be referred to as a "removable key," and can be a PROM, EPROM, USB dongle, smart card, read-only file on a mass storage device, NVRAM module, or the like. In some applications, the read-only file can be a digital certificate, which is described in more detail above. For a general discussion of symmetric and asymmetric keys, including public and private key pairs, see U.S. patent application Ser. No. 10/291,926 by Brosnan et al., filed on Nov. 7, 2002, and entitled "Identifying Message Senders." Also, for a general discussion of cryptography, see Schneier, Bruce, Applied Cryptography, John Wiley & Sons, Inc. In addition, for a general discussion of electronic keys and dongles that can be used with the present invention, see U.S. Pat. No. 6,439,996 by LeMay et al., entitled "Key for a Gaming Machine and Method of Use Thereof," issued Aug. 27, 2002.

After the files are decrypted by hardware cryptography device 902, the decrypted files are then passed to CPU 103. These decrypted files can then be read by CPU 103 if the files were not tampered with while they were encrypted. However, if the files were altered while they were encrypted, the altered content will be decrypted along with the legitimate portions of the data files. Consequently, the decrypted version of the altered content will result in garble that is unparseable. In some embodiments, when unparseable material is detected, then security measures can be triggered. For instance, gaming machine 102 can be reset after unparseable material is found. In addition, casino and/or gaming machine personnel can be notified.

With reference to FIG. 10, an embodiment of a process for securing a gaming system using a hardware cryptography device and a memory is shown. At 1000, the hardware cryptography device 902 (FIG. 9) receives an encrypted file from a memory. Next, at 1002, the hardware cryptography device 902 acquires a key from a storage location such as an EPROM, a USB dongle, the hardware cryptography device itself, the master gaming controller 101, or from a secure server. At 1004, the key acquired at operation 1002 can be used to decrypt the encrypted file. Specifically, as described above with regard to FIG. 9, if a single key is used, the acquired key can be used to directly decrypt the encrypted file. However, if two keys are used, the acquired key can be used to decrypt another key. Once this other key is decrypted, it can be used to decrypt the encrypted file. Any number of keys can be used in a similar manner to protect the contents of the file stored. After the file is decrypted, then at 1006, the decrypted file is sent to CPU 103.

As described above, storing encrypted data files in memory 900 improves the security of gaming machine 102. Specifically, if the memory 900 is lost or stolen, the contents of the memory 900 are safe from unauthorized users who could otherwise obtain sensitive data from the memory 900 if stored in plain view. Depending on the application, additional features can be included for added security. For instance, gaming machine 102 can detect if the decrypted file includes unparseable material, which suggests either that the encrypted file was altered after it was sent or that a rogue program resides on gaming machine 102, as described above with regard to FIG. 6. Once unparseable material is detected, then security measures can be effected such as resetting the gaming machine, and notifying casino and/or gaming machine personnel.

Another feature that can be included for added security involves verifying the contents of a data file either before or after it is decrypted by the hardware cryptography device. By verifying the file, gaming machine 102 can determine if the file has been altered in any way. For instance, a check sum algorithm can be used to create a signature for the encrypted or decrypted version of the file, and this signature can be encrypted and appended to the file before it is sent. When the file is retrieved, the check sum algorithm can be used to generate another signature. If the two signatures match, this suggests that the file has not been altered since the time the signature was generated. Other algorithms and methods can also be used to verify the file in a similar manner.

Yet another feature that can be included for added security involves authentication. As described above with regard to FIG. 6A, authentication is used to verify that the information comes from the actual sender. If information received is authentic, the receiver knows who created it and knows that it has not been altered since the sender created it. In one embodiment, the identity of a message sender may be determined using public-private encryption key pairs. Two gaming devices, each storing public-private encryption key pairs, may exchange public encryption keys. Then, the gaming devices may exchange a series of messages that are encrypted with each other's public keys. Although the embodiment described uses asymmetric key pairs, asymmetric and/or symmetric key pairs can be used for authentication, depending on the application. Furthermore, other methods can also be used to perform authentication in accordance with the techniques of the present invention. For a more detailed discussion of authentication, see the discussion above regarding FIG. 6A.

In the present embodiment, CPU 103 and memory 900 can each authenticate hardware cryptography device 902, and hardware cryptography device 902 can also authenticate CPU 103 and memory 900. It should be recognized that although specific examples are described in conjunction with the present embodiment, other methods can also be used to perform authentication in accordance with the techniques of the present invention.

Although FIGS. 9 and 10 have been described with regard to a particular embodiment, it should be recognized that modifications can be made within the scope of the present application. For instance, hardware cryptography device 902 can be used to encrypt data files passing from CPU 103 to memory 900. Furthermore, decrypted files can be sent from hardware cryptography device 902 to devices within gaming machine 102 other than CPU 103, depending on the application.

Figure 11:
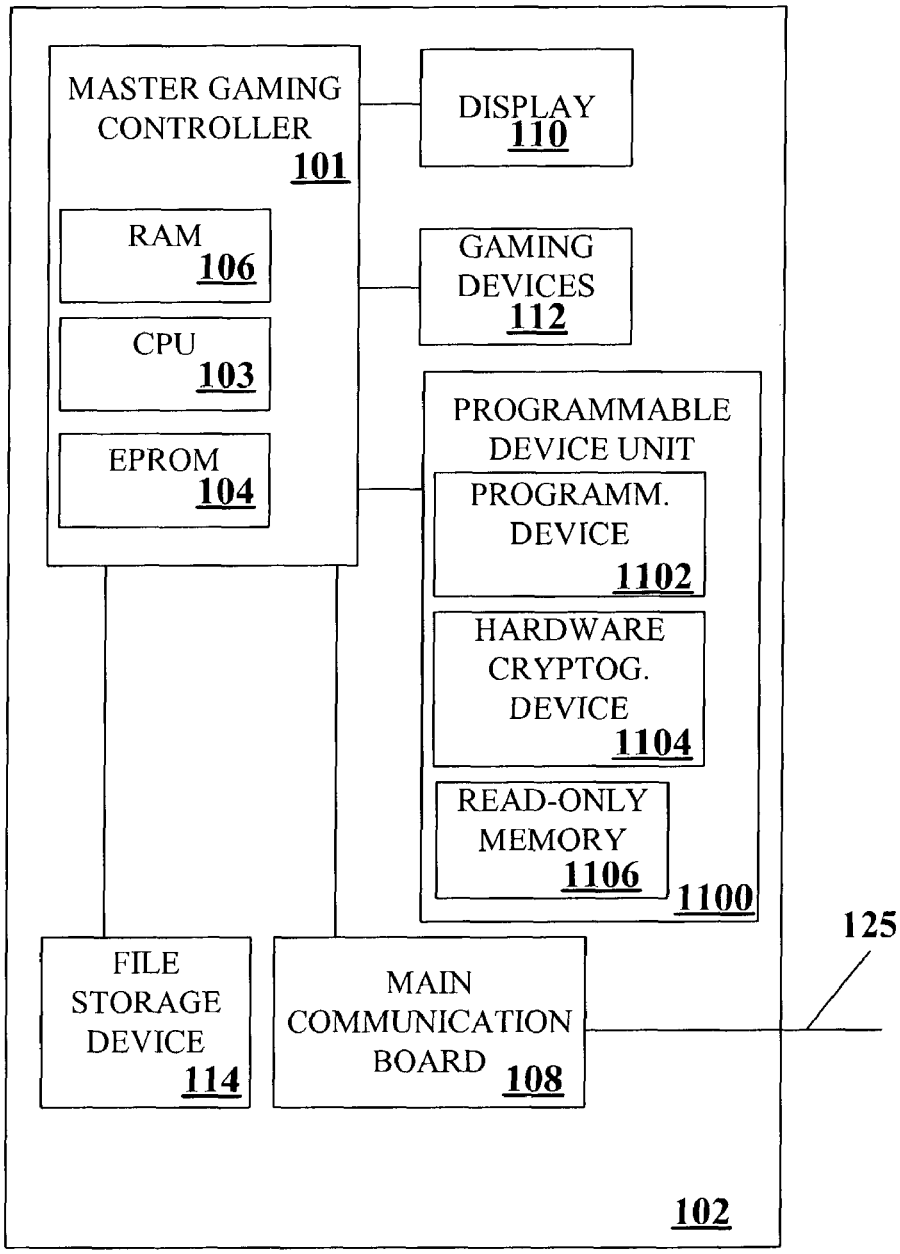
FIG. 11 is a block diagram of a gaming machine with a programmable device.
Figure 12:
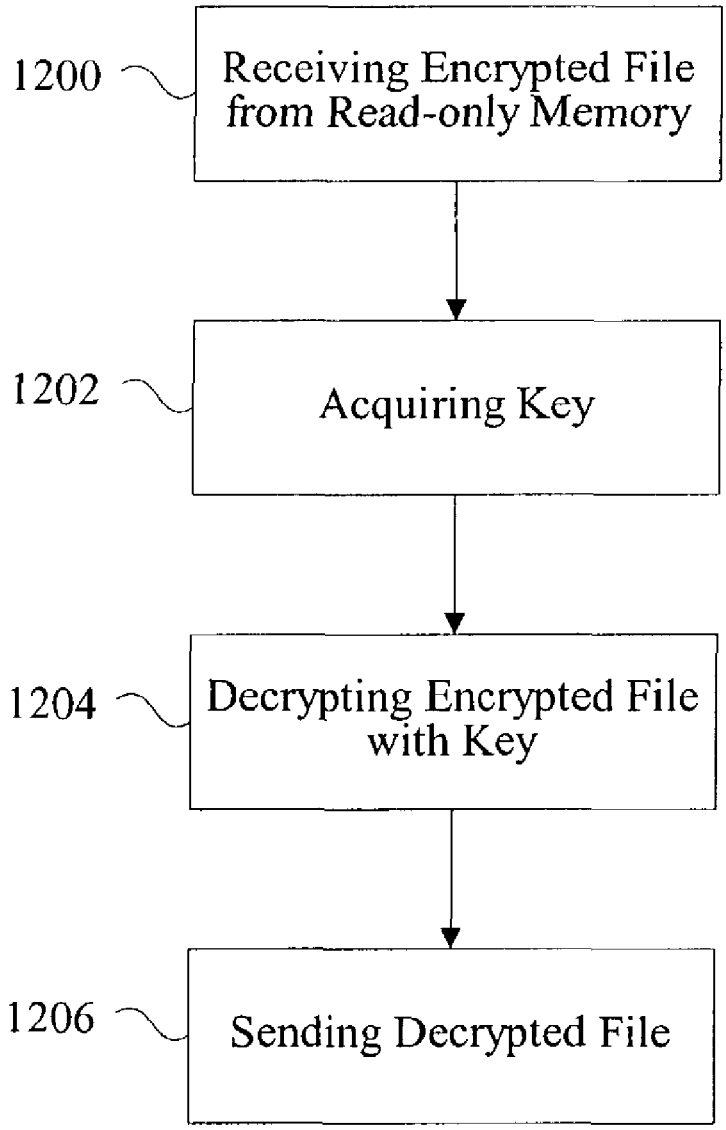
FIG. 12 is a flow diagram depicting a process of securing a gaming system having a programmable device.

FIGS. 11 and 12 depict an apparatus and process, respectively, for securing a gaming system using a hardware cryptography device with a programmable device unit. With reference to FIG. 11, shown is a block diagram of one embodiment of a gaming machine that includes a hardware cryptography device in accordance with the methods and apparatus of the present invention. In particular, the gaming machine shown is similar to the gaming machine depicted in FIG. 1 except that FIG. 11 includes a programmable device unit 1100 that can be used to control devices such as peripherals by performing sound processing, controlling motors, controlling lighting, controlling signage (e.g. a top box LED sign displaying a progressive jackpot amount), controlling a keypad (e.g. information passing between an ATM keypad and the CPU may be encrypted for added security), and the like. Specifically, programmable device unit 1100 can include programmable device 1102, hardware cryptography device 1104, and read-only memory 1106.

In the present embodiment, programmable device 1102 can be a field programmable gate array (FPGA), digital signal processor (DSP), programmable logic device (PLD), CPLD, or the like, which can be programmed to perform desired functions depending on the application. Furthermore, programmable device 1102 can be reprogrammed when necessary, as when updated functions are desired.

Read-only memory 1106 stores encrypted data files, which can be executable or non-executable files. In addition, read-only memory 1106 stores encrypted data files alongside decrypted data files in some embodiments, depending on the application. In some embodiments, read-only memory 1106 can be a PROM, EPROM, CD, DVD, smart card, USB dongle, flash drive, memory stick, read-only sector of a mass storage device, NVRAM module, or the like. Storing encrypted data files in read-only memory 1106 improves the security of gaming machine 102. Specifically, if the read-only memory 1106 is lost or stolen, the contents of the read-only memory 1106 are safe from unauthorized users who could otherwise obtain sensitive data from the read-only memory 1106 if stored in plain view.

Read-only memory 1106 stores data files that are used by programmable device 1102. Before the encrypted data files stored in read-only memory 1106 are passed to programmable device 1102, the encrypted data files are decrypted by hardware cryptography device 1104. Hardware cryptography device 1104 can be a field programmable gate array (FPGA) and/or one or more hardware encryption and/or decryption chips, such as the Intel IXP-425 network processor from Intel Corp. (Santa Clara, Calif.), the SE-64 ASIC from eNovatek Corp. (Taipei, Taiwan), the SafeXcel-1140 series from SafeNet, Inc. (Baltimore, Md.), the Hifn-7902 security processor from Hifn, Inc. (Los Gatos, Calif.). The hardware cryptography device 1104 can encrypt and/or decrypt data files using one or more symmetric or asymmetric keys. In one embodiment, a single key can be used to decrypt an encrypted data file passing from read-only memory 1106 to programmable device 1102. The key can be stored in any convenient memory location, such as an EPROM, a USB dongle, a smart card, a secure server, the hardware cryptography device 1104, or the master gaming controller 101. Once the hardware cryptography device 1104 obtains the key, the hardware cryptography device 1104 can use the key to decrypt an encrypted data file. If a symmetric key is used, the same key that was used to encrypt the data file can be used to decrypt the encrypted data file. In contrast, if an asymmetric key was used, a different key from the one used to encrypt a data file can be used to decrypt the encrypted data file.

In other embodiments, two keys can be used to decrypt an encrypted data file. Specifically, one key can be stored with the encrypted data file on read-only memory 1106. This key can be used by the hardware cryptography device 1104 to decrypt the encrypted data file. In order to prevent an unauthorized user from using this key to decrypt the encrypted data file stored with it on read-only memory 1106, the key is encrypted by another key. This other key can be stored in any convenient location, such as an EPROM, a USB dongle, the hardware cryptography device 1104, or a secure server. When the hardware cryptography device 1104 receives an encrypted data file along with an encrypted key, the hardware cryptography device 1104 can retrieve the other key needed to decrypt the encrypted key. Once the hardware cryptography device 1104 decrypts the encrypted key, then the newly decrypted key can be used to decrypt the encrypted data file. If symmetric keys were used, the same key that was used to encrypt the data file can be used to decrypt the encrypted data file. In contrast, if asymmetric keys were used, a different key from the one used to encrypt a data file can be used to decrypt the encrypted data file. Using two keys to decrypt and/or encrypt data files in this manner provides added security because either or both of the two keys can be changed or updated at any time to prevent unauthorized access to and tampering with the data files. Furthermore, the key stored with the encrypted data file can be easily changed or updated without much time or expense. In some embodiments, the memory location where the key is stored can be removed. As described above, the removable memory location where the key is stored can also be referred to as a "removable key," and can be a PROM, EPROM, USB dongle, smart card, read-only file on a mass storage device, NVRAM module, or the like. In some applications, the read-only file can be a digital certificate, which is described in more detail above. For a general discussion of symmetric and asymmetric keys, including public and private key pairs, see U.S. patent application Ser. No. 10/291,926 by Brosnan et al., filed on Nov. 7, 2002, and entitled "Identifying Message Senders." Also, for a general discussion of cryptography, see Schneier, Bruce, Applied Cryptography, John Wiley & Sons, Inc. In addition, for a general discussion of electronic keys and dongles that can be used with the present invention, see U.S. Pat. No. 6,439,996 by LeMay et al., entitled "Key for a Gaming Machine and Method of Use Thereof," issued Aug. 27, 2002.

After the files are decrypted by hardware cryptography device 1104, the decrypted files are then passed to programmable device 1102. These decrypted files can then be read by programmable device 1102 if the files were not tampered with while they were encrypted. However, if the files were altered while they were encrypted, the altered content will be decrypted along with the legitimate portions of the data files. Consequently, the decrypted version of the altered content will result in garble that is unparseable. In some embodiments, when unparseable material is detected, then security measures can be triggered. For instance, gaming machine 102 can be reset after unparseable material is found. In addition, casino and/or gaming machine personnel can be notified.

With reference to FIG. 12, an embodiment of a process for securing a gaming system with a programmable device unit is shown. At 1200, the hardware cryptography device 1104 (FIG. 11) receives an encrypted file from read-only memory 1106. Next, at 1202, the hardware cryptography device 1104 acquires a key from a storage location such as an EPROM, a USB dongle, the hardware cryptography device itself, or a secure server. At 1204, the key acquired at operation 1202 can be used to decrypt the encrypted file. Specifically, as described above with regard to FIG. 11, if a single key is used, the acquired key can be used to directly decrypt the encrypted file. However, if two keys are used, the acquired key can be used to decrypt another key. Once this other key is decrypted, it can be used to decrypt the encrypted file. Any number of keys can be used in a similar manner to protect the contents of the file stored. After the file is decrypted, then at 1206, the decrypted file is sent to programmable device 1102.

Storing encrypted data files in read-only memory 1106 improves the security of gaming machine 102. Specifically, if read-only memory 1106 is lost or stolen, the contents of read-only memory 1106 are safe from unauthorized users who could otherwise obtain sensitive data from read-only memory 1106 if stored in plain view. Depending on the application, additional features can be included for added security. For instance, gaming machine 102 can detect if the decrypted file includes unparseable material, which suggests either that the encrypted file was altered after it was sent or that a rogue program resides on gaming machine 102, as described above with regard to FIG. 6. Once unparseable material is detected, then security measures can be effected such as resetting the gaming machine, and notifying casino and/or gaming machine personnel.

Another feature that can be included for added security involves verifying the contents of a data file either before or after it is decrypted by the hardware cryptography device. By verifying the file, gaming machine 102 can determine if the file has been altered in any way. For instance, a check sum algorithm can be used to create a signature for the encrypted or decrypted version of the file, and this signature can be encrypted and appended to the file before it is sent. When the file is retrieved, the check sum algorithm can be used to generate another signature. If the two signatures match, this suggests that the file has not been altered since the time the signature was generated. Other algorithms and methods can also be used to verify the file in a similar manner.

Yet another feature that can be included for added security involves authentication. As described above with regard to FIG. 6A, authentication is used to verify that the information comes from the actual sender. If information received is authentic, the receiver knows who created it and knows that it has not been altered since the sender created it. In one embodiment, the identity of a message sender may be determined using public-private encryption key pairs. Two gaming devices, each storing public-private encryption key pairs, may exchange public encryption keys. Then, the gaming devices may exchange a series of messages that are encrypted with each other's public keys. Although the embodiment described uses asymmetric key pairs, asymmetric and/or symmetric key pairs can be used for authentication, depending on the application. Furthermore, other methods can also be used to perform authentication in accordance with the techniques of the present invention. For a more detailed discussion of authentication, see the discussion above regarding FIG. 6A.

In the present embodiment, programmable device 1102 and read-only memory 1106 can each authenticate hardware cryptography device 1104, and hardware cryptography device 1104 can also authenticate programmable device 1102 and read-only memory 1106. It should be recognized that although specific examples are described in conjunction with the present embodiment, other methods can also be used to perform authentication in accordance with the techniques of the present invention.

Although FIGS. 11 and 12 have been described with regard to a particular embodiment, it should be recognized that modifications can be made within the scope of the present application. For instance, hardware cryptography device 1104 can be used to encrypt data files passing from programmable device 1102 to read-only memory 1106. Furthermore, decrypted files can be sent from hardware cryptography device 1104 to devices within gaming machine 102 other than programmable device 1102, depending on the application.

Figure 13:
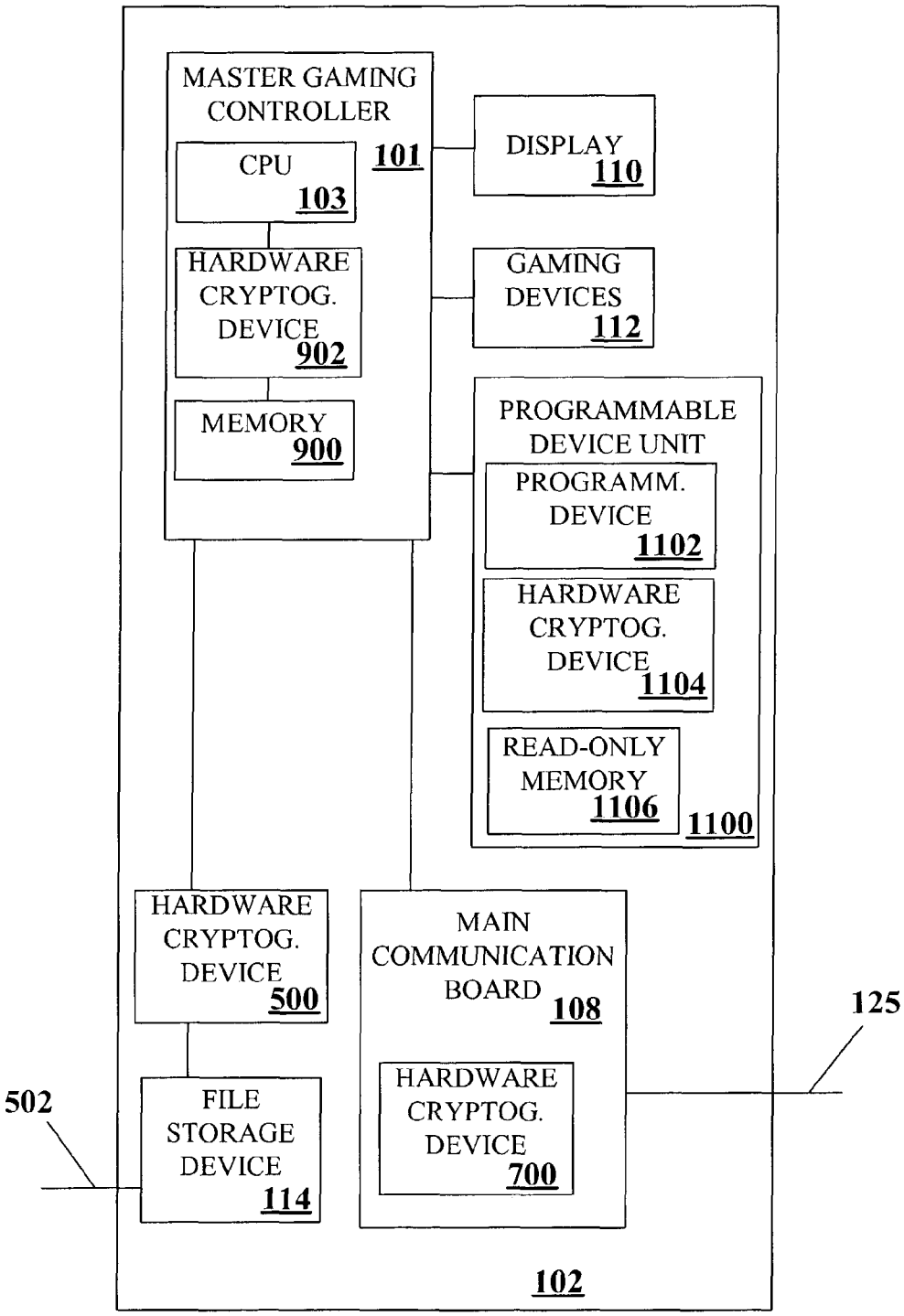
FIG. 13 is a block diagram of a gaming machine system with hardware cryptography devices.
Figure 14:
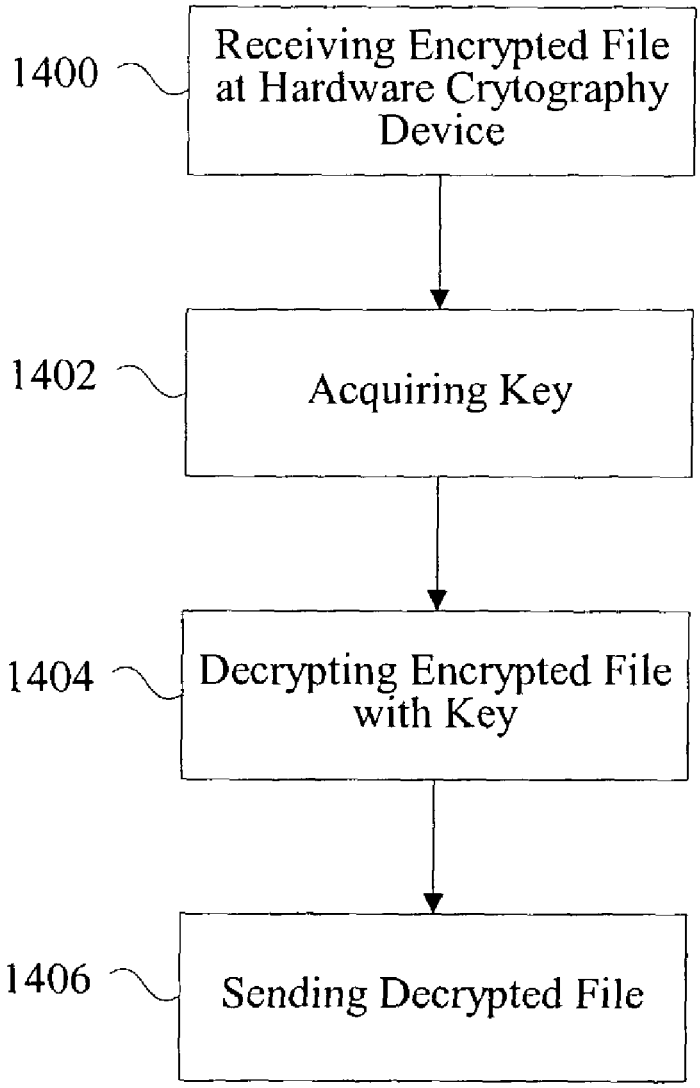
FIG. 14 is a flow diagram depicting a process of securing a gaming system using hardware cryptography devices.

FIGS. 13 and 14 depict an apparatus and process, respectively, for securing a gaming machine system having devices and communication paths. With reference to FIG. 13, shown is a block diagram of an embodiment of a gaming machine that includes hardware cryptography devices. In particular, the gaming machine includes a combination of the embodiments described above with regard to FIGS. 5-12. Specifically, in the present embodiment, file storage device 114 stores encrypted data files and hardware cryptography device 500 can encrypt and/or decrypt data files passing between file storage device 114 and any other device, such as master gaming controller 101. For a more detailed discussion about file storage device 114 and hardware cryptography device 500, refer to FIGS. 5 and 6 above, along with the accompanying description.

Furthermore, in the present embodiment, main communication board 108 includes hardware cryptography device 700. Gaming machine 102 sends and receives data files to and from external devices through main communication board 108 and communication path 125. Before data files are sent from main communication board 108 to external devices, the data files can be encrypted by hardware cryptography device 700. After data files are received from external devices, the data files can be decrypted by hardware cryptography device 700. For a more detailed discussion about main communication board 108 and hardware cryptography device 700, refer to FIGS. 7 and 8 above, along with the accompanying description.

Also in the present embodiment, master gaming controller includes memory 900 and hardware cryptography device 902. Memory 900 stores encrypted data files that are used by CPU 103, and other components depending on the application. Before the encrypted data files stored in memory 900 are passed to CPU 102, the encrypted data files are decrypted by hardware cryptography device 902. Furthermore, when data files are passed from CPU 103 to memory 900, hardware cryptography device can encrypt the data files before the data files reach memory 900. For a more detailed discussion about memory 900 and hardware cryptography device 902, refer to FIGS. 9 and 10 above, along with the accompanying description.

In addition, the present embodiment includes a programmable device unit 1100. Programmable device unit 1100 includes programmable device 1102, hardware cryptography device 1104, and read-only memory 1106. read-only memory 1106 stores encrypted data files that are used by programmable device 1102, and other components depending on the application. Before the encrypted data files stored on read-only memory 1106 are passed to programmable device 1102, the encrypted data files are decrypted by hardware cryptography device 1104. Furthermore, when data files are passed from programmable device 1102 to read-only memory 1106, hardware cryptography device 1104 can encrypt the data files before the data files reach read-only memory 1106. For a more detailed discussion about programmable device unit, refer to FIGS. 11 and 12 above, along with the accompanying description.

In one preferred embodiment, file storage device 114 can serve as a centralized storage device for gaming machine 102. Specifically, various components of gaming machine 102 can access file storage device 114 for encrypted or unencrypted files. In another preferred embodiment, file storage device 114 can be located remotely to gaming machine 102, as shown in FIG. 2 as remote file storage devices 116 and 118. These remote file storage device(s) can be accessed by various gaming machines and gaming machine components. By locating the file storage device(s) remotely and making them accessible to various machines, storage space can be saved and redundancy can be reduced.

In other embodiments, one or more of hardware cryptography devices 500, 700, 902, and 1104 can use the same key or keys to decrypt and/or encrypt data. For instance, all of the hardware cryptography devices 500, 700, 902, and 1104 can use the same symmetric key to encrypt and/or decrypt data. This symmetric key can be stored in a single location and accessed by each of the hardware cryptography devices 500, 700, 902, and 1104, or it can be stored in multiple locations, depending on the application.

Turning to FIG. 14, an embodiment of a process for securing a gaming system using a hardware cryptography device is shown. The process can be used for any of the hardware cryptography devices 500, 700, and 902, which are shown in FIG. 13. At 1400, the hardware cryptography device 500, 700, or 902 receives an encrypted file. Next, at 1402, the hardware cryptography device 500, 700, or 902 acquires a key from a storage location such as an EPROM, a USB dongle, the hardware cryptography device itself, the master gaming controller 101, or from a secure server. At 1404, the key acquired at operation 1402 can be used to decrypt the encrypted file. Specifically, as described above with regard to FIGS. 5-10, if a single key is used, the acquired key can be used to directly decrypt the encrypted file. However, if two keys are used, the acquired key can be used to decrypt another key. Once this other key is decrypted, it can be used to decrypt the encrypted file. Any number of keys can be used in a similar manner to protect the contents of the file stored. After the file is decrypted, then at 1406, the decrypted file is sent to a desired destination.

Using hardware cryptography devices to secure gaming machine 102 and its network provides several benefits. The descriptions of FIGS. 5-10 include some of these benefits. In addition, using hardware cryptography devices with a gaming machine system allows fast communications across the gaming machine and network. Specifically, using hardware cryptography devices provides a secure system at wireline speed, with real-time encryption and decryption capabilities without burdening the CPU. In addition, the hardware cryptography devices can obviate the need for verifying and authenticating data files. Instead, in some applications, when decrypted data is found to be unparseable, as described above, the gaming machine can detect that the decrypted data has been altered or that it did not come from a trusted source. However, the hardware cryptography devices can also be used along with verification and authentication techniques depending on the application.

In addition, using hardware cryptography devices at various locations in the gaming system can provide security for many aspects of the system. For instance, as shown in FIGS. 13 and 14, encrypted data files can be stored on file storage device 114. If file storage device 114 is lost or stolen, its contents will be secure. Furthermore, communications to and from main communication board 108 along communication path 125 can be encrypted, thereby securing the contents of these communications over the network. Moreover, encrypted data files can be stored in memory 900. If memory 900 is lost or stolen, its contents will be secure. In this manner, various aspects of the gaming machine system can be secured. Other aspects of the gaming machine system can be secured in similar fashion.

Because the hardware cryptography devices are independent of the operating systems used by the gaming machine devices, using hardware cryptography devices to secure the gaming system can allow many applications to be developed and run by different devices without having to unify the operating systems of the devices. For instance, gaming machines can run QNX, lottery machines and PTTVs can run Linux, CVTs can run PSOS, and floor control servers can run Windows 2000, all while hardware cryptography devices are employed in the system.

In addition, using hardware cryptography devices to secure communication paths is compatible with legacy machines. In particular, hardware cryptography devices can be built into the legacy machines' communication boards without requiring any software updates or modifications. Accordingly, legacy machines can communicate with newer gaming machines over the same network without costly software developments or improvements.

By using hardware cryptography devices instead of software cryptography to create a secure system, software development efforts can be directed more toward content development rather than content protection. Furthermore, with little or no software cryptography used, the number of software updates, such as bug fixes and security patches, can be reduced or eliminated, thereby freeing software developers to focus on content development. In addition, hardware cryptography devices are easy to use because the operation of the hardware devices is transparent to the users and applications on the gaming machines and components.

CONCLUSION

Although the present invention has been described in conjunction with a number of exemplary embodiments depicted in the appended drawing figures, various modifications can be made without departing from the spirit and/or scope of the present invention. Therefore, the present invention should not be construed as being limited to the specific forms shown in the drawings and described above.

What is claimed is:

1. A gaming machine comprising:

a cabinet to house a plurality of gaming components;

a master gaming controller housed within the cabinet and configured to control a game of chance played on the gaming machine;

a file storage device configured to store a first plurality of encrypted data files;

a first communication path between the master gaming controller and the file storage device; and a first dedicated hardware cryptography chip configured to decrypt or encrypt data along the first communication path, the first dedicated hardware cryptography chip housed permanently within the cabinet, wherein the first dedicated hardware cryptography chip includes a processing circuit configured to encrypt or decrypt data along the first communication path and the first dedicated hardware cryptography chip being configured to be authenticated by the master gaming controller or the file storage device by using randomly generated information, wherein the randomly generated information is generated by at least one of the master gaming controller and the file storage device to verify the identity of the first dedicated hardware cryptography chip.

2. The gaming machine of claim 1, wherein the first dedicated hardware cryptography chip is configured to decrypt the encrypted data files before the data files reach the master gaming controller from the file storage device.

3. The gaming machine of claim 1, wherein the first dedicated hardware cryptography chip is configured to encrypt data along the first communication path before the data reaches the file storage device from the master gaming controller.

4. The gaming machine of claim 1, wherein the first communication path is implemented as a SSL session, a VPN tunnel, or hardware-cryptographic-enabled transport.

5. The gaming machine of claim 1, wherein the file storage device is a hard drive, a CD-R, a CD-RW, a DVD-R, a DVD-RW, a flash drive, a compact flash drive, or memory stick.

6. The gaming machine of claim 1, wherein the master gaming controller comprises:

a memory configured to store a second plurality of encrypted data files;

a processor configured to execute gaming software programs; and wherein the gaming machine further comprises:

a second communication path between the processor and the memory; and a second dedicated hardware cryptography chip configured to encrypt or decrypt data along the second communication path.

7. The gaming machine of claim 6, wherein the second dedicated hardware cryptography chip is configured to decrypt the second plurality of encrypted data files before the data files reach the processor from the memory and, wherein the second dedicated hardware cryptography chip is configured to encrypt data along the second communication path before the data reaches the memory from the processor.

8. The gaming machine of claim 6, wherein the memory is a portable memory device that is removable from the master gaming controller.

9. The gaming machine of claim 8, wherein the portable memory device is an NVRAM module, a USB memory stick, a flash drive, a compact flash module, a smart card or a PCMCIA memory card.

10. The gaming machine of claim 6, wherein the second dedicated hardware cryptography chip is a field programmable gate array (FPGA).

11. The gaming machine of claim 6, wherein a key is used by the first dedicated hardware cryptography chip to decrypt data, and wherein the same key is used by the second dedicated hardware cryptography chip to decrypt data.

12. The gaming machine of claim 11, wherein the key is a symmetric or asymmetric key that can be used to encrypt and decrypt data.

13. The gaming machine of claim 1, further comprising:

a first communication board associated with the master gaming controller, wherein the first communication board is configured to communicate with a second communication board that is external to the gaming machine;

a second communication path between the first communication board and the second communication board; and a second dedicated hardware cryptography chip configured to decrypt or encrypt data along the second communication path before the data passes between the first communication board and the second communication board.

14. The gaming machine of claim 13, wherein the second communication board is associated with a server or a peripheral device.

15. The gaming machine of claim 13, wherein a key is used by the first dedicated hardware cryptography chip to decrypt data, and wherein the same key is used by the second dedicated hardware cryptography chip to decrypt data.

16. The gaming machine of claim 15, wherein the key is a symmetric or asymmetric key that can be used to encrypt and decrypt data.

17. The gaming machine of claim 1, further comprising:

a programmable device configured to execute software programs;

a read-only memory configured to store a second plurality of encrypted data files;

a second communication path between the programmable device and the read-only memory; and a second dedicated hardware cryptography chip configured to decrypt or encrypt data along the second communication path.

18. The gaming machine of claim 17, wherein the second dedicated hardware cryptography chip is configured to decrypt the second plurality of encrypted data files before the data files reach the programmable device from the read-only memory, and wherein the second dedicated hardware cryptography chip is configured to encrypt data along the second communication path before the data reaches the read-only memory from the programmable device.

19. The gaming machine of claim 17, wherein the read-only memory is selected from a group consisting of a PROM, an EPROM, a CD, a DVD, a smart card, a USB dongle, a flash drive, a memory stick, a read-only segment of a mass storage device, or an NVRAM module.

20. The gaming machine of claim 17, wherein a key is used by the first dedicated hardware cryptography chip to decrypt data, and wherein the same key is used by the second dedicated hardware cryptography chip to decrypt data.

21. The gaming machine of claim 20, wherein the key is a symmetric or asymmetric key that can be used to encrypt and decrypt data.

22. The gaming machine of claim 1, further comprising a memory location for a key, wherein the key is used to decrypt data along the first communication path.

23. The gaming machine of claim 22, wherein the key is updatable.

24. The gaming machine of claim 22, wherein the memory location is removable.

25. The gaming machine of claim 22, wherein the memory location is located in a smart card, an EPROM, a USB dongle, a secure server, or the first dedicated hardware cryptography chip.

26. The gaming machine of claim 1, further comprising a communication interface configured to accept a removable key.

27. The gaming machine of claim 26, wherein a key stored on a removable key can be downloaded to the first dedicated hardware cryptography chip through the communication interface.

28. The gaming machine of claim 27, wherein the removable key is selected from the group consisting of a PROM, an EPROM, a USB dongle, a smart card, a read-only file on a mass storage device, and an NVRAM module.

29. The gaming machine of claim 28, wherein the read-only file is a digital certificate on the mass storage device.

30. The gaming machine of claim 1, further comprising a communication interface to download a key from an external network for use by the first dedicated hardware cryptography chip.

31. The gaming machine of claim 1, wherein the first dedicated hardware cryptography chip is further configured to decrypt, encrypt, or decrypt and encrypt an entire data file.

32. The gaming machine of claim 1, wherein the dedicated hardware cryptography chip is independent of an operating system of the gaming machine.

33. The gaming machine of claim 1, wherein the processing circuit comprises a processor or an application specific integrated circuit.

34. A gaming machine comprising:

a cabinet to house a plurality of gaming components;

a master gaming controller housed within the cabinet and configured to control a game of chance played on the gaming machine, wherein the master gaming controller includes:

a memory configured to store a plurality of encrypted data files, a processor configured to execute gaming software programs;

a communication path between the processor and the memory; and a dedicated hardware cryptography chip configured to decrypt or encrypt data along the communication path, the dedicated hardware cryptography chip housed permanently within the cabinet, wherein the dedicated hardware cryptography chip includes a processing circuit configured to encrypt or decrypt data along the communication path, and the dedicated hardware cryptography chip being configured to be authenticated by the processor or the memory device by using randomly generated information, wherein the randomly generated information is generated by at least one of the processor and the memory device to verify the identity of the dedicated hardware cryptography chip.

35. The gaming machine of claim 34, wherein the dedicated hardware cryptography chip is configured to decrypt the encrypted data files before the data files reach the processor from the memory.

36. The gaming machine of claim 34, wherein the dedicated hardware cryptography chip is configured to encrypt data along the communication path before the data reaches the memory from the processor.

37. The gaming machine of claim 34, wherein the memory is a portable memory device that is removable from the master gaming controller.

38. The gaming machine of claim 37, wherein the portable memory device is an NVRAM module, a USB memory stick, a flash drive, a compact flash module, a smart card, a USB dongle, or a PCMCIA memory card.

39. The gaming machine of claim 34, wherein the dedicated hardware cryptography chip is a field programmable gate array (FPGA).

40. The gaming machine of claim 34, wherein the dedicated hardware cryptography chip further comprises a memory location for a key.

41. The gaming machine of claim 40, wherein the key is updatable.

42. The gaming machine of claim 34, further comprising a communication interface to download a key from an external network for use by the dedicated hardware cryptography chip.

43. The gaming machine of claim 34, further comprising a communication interface configured to accept a removable key, wherein the removable key can be downloaded to the dedicated hardware cryptography chip through the communication interface.

44. The gaming machine of claim 43, wherein the removable key is selected from the group consisting of a PROM, an EPROM, a USB dongle, a smart card, a read-only file on a mass storage device, and an NVRAM module.

45. The gaming machine of claim 44, wherein the read-only file is a digital certificate.

46. A gaming machine comprising:

a cabinet to house a plurality of gaming components;

a master gaming controller housed within the cabinet and configured to control a game of chance played on the gaming machine;

a file storage device;

a first communication board coupled to the master gaming controller, wherein the first communication board is configured to communicate with a second communication board that is external to the gaming machine;

a first communication path between the first communication board and the second communication board;

a first dedicated hardware cryptography chip configured to encrypt or decrypt data along the first communication path before the data passes between the first communication board and the second communication board, the dedicated hardware cryptography chip housed permanently within the cabinet;

a second communication path configured to communicate a message between the master gaming controller and the file storage device; and a second dedicated hardware cryptography chip configured to encrypt or decrypt the message, wherein the second dedicated hardware cryptography chip includes a processing circuit configured to encrypt or decrypt the message, and the second dedicated hardware cryptography chip being configured to be authenticated by the master gaming controller or the file storage device by using randomly generated information, wherein the randomly generated information is generated by at least one of the master gaming controller and the file storage device to verify the identity of the second dedicated hardware cryptography chip.

47. The gaming machine of claim 46, wherein the second communication board is associated with a server or a peripheral device.

48. The gaming machine of claim 46, wherein the first dedicated hardware cryptography chip further comprises a memory location for a key.

49. The gaming machine of claim 48, wherein the key is updatable.

50. The gaming machine of claim 46, further comprising a communication interface configured to accept a removable key, wherein the removable key can be downloaded to the first dedicated hardware cryptography chip through the communication interface.

51. The gaming machine of claim 46, further comprising a communication interface configured to download a key from an external network for use by the first dedicated hardware cryptography chip.

52. The gaming machine of claim 50, wherein the removable key is selected from the group consisting of a PROM, an EPROM, a USB dongle, a smart card, a read-only file on a mass storage device, and an NVRAM module.

53. The gaming machine of claim 52, wherein the read-only file is a digital certificate on the mass storage device.

54. A gaming machine comprising:

a cabinet to house a plurality of gaming components;

a programmable device configured to execute gaming software programs;

a read-only memory configured to store a plurality of encrypted data files;

a communication path between the programmable device and the read-only memory; and a dedicated hardware cryptography chip configured to decrypt or encrypt data along the communication path, the dedicated hardware cryptography chip housed permanently within the cabinet, wherein the dedicated hardware cryptography chip includes a processing circuit configured to encrypt or decrypt data along the communication path, and the dedicated hardware cryptography chip being configured to be authenticated by the programmable device or the read-only memory by using randomly generated information, wherein the randomly generated information is generated by at least one of the programmable device and the read-only memory to verify the identity of the dedicated hardware cryptography chip.

55. The gaming machine of claim 54, wherein the dedicated hardware cryptography chip is configured to decrypt the encrypted data files before the data files reach the programmable device from the read-only memory.

56. The gaming machine of claim 54, wherein the dedicated hardware cryptography chip is configured to encrypt data along the communication path before the data reaches the read-only memory from the programmable device.

57. The gaming machine of claim 54, wherein the read-only memory is selected from the group consisting of a PROM, an EPROM, a CD, a DVD, a smart card, a USB dongle, a flash drive, a memory stick, a read-only segment of a mass storage device, and an NVRAM module.

58. A gaming machine comprising:

a cabinet to house a plurality of gaming components;

a master gaming controller housed within the cabinet and configured to control a game of chance played on the gaming machine;

a file storage device configured to store a plurality of encrypted data files that are not decryptable by the gaming machine;

a communication path between the master gaming controller and the file storage device; and a dedicated hardware cryptography chip configured to encrypt data along the communication path before the data reaches the file storage device from the master gaming controller, the dedicated hardware cryptography chip housed permanently within the cabinet, wherein the data encrypted by the dedicated hardware cryptography chip and stored at the file storage device is not decryptable by the gaming machine, wherein the dedicated hardware cryptography chip comprises a processing circuit configured to encrypt or decrypt data along the communication path, and the dedicated hardware cryptography chip being configured to be authenticated by the master gaming controller or the file storage device by using randomly generated information, wherein the randomly generated information is generated by at least one of the master gaming controller and the file storage device to verify the identity of the dedicated hardware cryptography chip.

59. The gaming machine of claim 58, wherein the encrypted data include records of gaming machine activities, and wherein the encrypted data is not decryptable by the gaming machine.

60. The gaming machine of claim 59, wherein the records of gaming machine activities include an amount of money or credits that the gaming machine has received and an amount of money or credits that the gaming machine has paid out.

61. The gaming machine of claim 58, wherein the file storage device is a hard drive, a CD-R, a CD-RW, a DVD-R, a DVD-RW, a flash card drive, a compact flash drive, or memory stick.

62. The gaming machine of claim 58, further comprising a memory location for a key, wherein the memory location is located in a smart card, an EPROM, a USB dongle, a secure server, or the dedicated hardware cryptography chip.

63. The gaming machine of claim 62, wherein the key is updatable.

64. The gaming machine of claim 62, wherein the memory location is removable.

65. A method of securing gaming machine data within a gaming machine, the method comprising:

storing an encrypted file within the gaming machine;

receiving the encrypted file at a dedicated hardware cryptography chip housed permanently within a cabinet of the gaming machine, wherein the dedicated hardware cryptography chip is configured to decrypt data and includes a processing circuit;

verifying an identity of the dedicated hardware cryptography chip by authenticating the dedicated hardware cryptography chip, wherein the authenticating is performed by using randomly generated information;

acquiring a first key at the dedicated hardware cryptography chip;

decrypting the encrypted file using the first key; and executing a gaming software program using the decrypted file.

66. The method of claim 65, wherein the encrypted file is received from a file storage device configured to store a plurality of data files, and wherein the gaming software program is a game of chance executed by a master gaming controller.

67. The method of claim 66, wherein the encrypted file is passed from a communication board to the file storage device before the file storage device passes the encrypted file to the dedicated hardware cryptography chip.

68. The method of claim 65, wherein the encrypted file is received from an external device, and wherein the dedicated hardware cryptography chip is associated with a communication board.

69. The method of claim 65, wherein the encrypted file is received from a portable memory device associated with a master gaming controller, wherein the dedicated hardware cryptography chip is associated with the master gaming controller, and wherein the gaming software program is a game of chance executed by the master gaming controller.

70. The method of claim 69, wherein the portable memory device is removable from the master gaming controller.

71. The method of claim 69, wherein the portable memory device is an NVRAM module, a USB memory stick, a flash drive, a compact flash module, a smart card, or a PCMCIA memory card.

72. The method of claim 65, wherein the encrypted file is received from an EPROM configured to store a plurality of data files, and wherein the gaming software program is executed by a programmable device.

73. The method of claim 65, wherein the dedicated hardware cryptography chip is a field programmable gate array (FPGA).

74. The method of claim 65, wherein the first key is acquired from a PROM, a USB dongle, the dedicated hardware cryptography chip, a secure server, or the master gaming controller.

75. The method of claim 65, further comprising authenticating the encrypted file.

76. The method of claim 65, further comprising authenticating the decrypted file.

77. The method of claim 65, further comprising verifying the encrypted file.

78. The method of claim 65, further comprising verifying the decrypted file.

79. The method of claim 65, further comprising resetting the gaming machine if the decrypted file is unparsedable.

80. The method of claim 65, further comprising sending a notification if the decrypted file is unparsedable.

81. The method of claim 65, further comprising:

acquiring a second key at the dedicated hardware cryptography chip, wherein the first key is encrypted and wherein the second key can be used to decrypt the first key; and decrypting the first key at the dedicated hardware cryptography chip using the second key.

82. The method of claim 65, wherein the dedicated hardware cryptography chip is further configured to decrypt an entire data file.

* * * * *